US010508393B1

(12) United States Patent
Page

(10) Patent No.: US 10,508,393 B1
(45) Date of Patent: Dec. 17, 2019

(54) PORTABLE VEHICLE BARRIER

(71) Applicant: James H. Page, Bottineau, ND (US)

(72) Inventor: James H. Page, Bottineau, ND (US)

( * ) Notice: Subject to any disclaimer, the term of this patent is extended or adjusted under 35 U.S.C. 154(b) by 0 days.

(21) Appl. No.: 16/280,318

(22) Filed: Feb. 20, 2019

(51) Int. Cl.
*E01F 13/02* (2006.01)
*E01F 13/12* (2006.01)

(52) U.S. Cl.
CPC ..... *E01F 13/02* (2013.01); *E01F 13/12* (2013.01)

(58) Field of Classification Search
CPC ..... E01F 13/02; E01F 13/12
See application file for complete search history.

(56) References Cited

U.S. PATENT DOCUMENTS 1,232,575 A * 7/1917 Lefort ..... F41H 11/08 109/49.5
2,480,382 A * 8/1949 Pagliuso ..... F16B 7/1472 135/81
2,507,880 A * 5/1950 Bell ..... E01F 13/02 182/108
3,482,820 A * 12/1969 Angello ..... E01F 13/02 116/63 P
4,065,104 A * 12/1977 Pass ..... E01F 13/02 256/13.1
4,096,782 A * 6/1978 Deschenes ..... E01F 13/12 89/1.11
5,328,292 A * 7/1994 Williams ..... E01F 13/12 404/6
5,572,188 A * 11/1996 McDowell, II ..... B60Q 7/00 116/63 P
6,409,418 B1 * 6/2002 Blair ..... E01F 13/123 404/6
6,709,190 B1 * 3/2004 Partin ..... E01F 13/12 404/6
8,210,767 B1 * 7/2012 Swahlan ..... F41H 11/08 256/1
8,231,303 B1 * 7/2012 Bowen ..... F41H 11/08 404/6
8,523,478 B2 * 9/2013 Swahlan ..... F41H 11/08 256/1

(Continued)

FOREIGN PATENT DOCUMENTS

JP 2007/154417 6/2007
JP 2018/062841 4/2018
WO WO 2011/062479 5/2011

OTHER PUBLICATIONS

PCT International Search Report and Opinion for PCT/US19/18717; dated May 9, 2019.

(Continued)

*Primary Examiner* — Abigail A Risic
(74) *Attorney, Agent, or Firm* — Neustel Law Offices

(57) ABSTRACT

A portable vehicle barrier for preventing the passage of unauthorized or dangerous vehicles into a protected area. The portable vehicle barrier generally includes a horizontal main beam and a plurality of spar assemblies, comprising spars radially spaced apart from each other. The spar assemblies are also spaced apart from each other along the main beam between the ends of the main beam. Accordingly, a number of spars will engage the ground or a road surface at an angle, and a number of opposite spars will be angled to engage an approaching vehicle, so as to penetrate the vehicle if it does not stop at the barrier.

18 Claims, 36 Drawing Sheets

(56) References Cited

U.S. PATENT DOCUMENTS

| | | | | |
|---|---|---|---|---|
| 8,858,113 | B1 * | 10/2014 | Bettendorf | E01F 13/12 404/6 |
| 9,000,918 | B1 * | 4/2015 | McLaughlin | G08B 13/12 340/540 |
| 9,169,608 | B1 * | 10/2015 | DeVilliers, Jr. | E01F 13/12 |
| 2008/0308780 | A1 * | 12/2008 | Sloan | E01F 13/12 256/31 |
| 2010/0044661 | A1 * | 2/2010 | Weiner | E01F 13/028 256/1 |
| 2012/0251238 | A1 | 10/2012 | Swahlan | |
| 2017/0204575 | A1 * | 7/2017 | Klein | E01F 13/12 |

OTHER PUBLICATIONS https://www.youtube.com/watch?v=92P-xTtyD7s; YouTube Webpage "MVB 3X The New Modular Vehicle Barrier with ~667 KJ Energy Absorption"; Mar. 13, 2018.

* cited by examiner

PORTABLE VEHICLE BARRIER

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a portable vehicle barrier for excluding unwanted or unauthorized vehicles from an area.

Related Art

Any discussion of the related art throughout the specification should in no way be considered as an admission that such related art is widely known or forms part of common general knowledge in the field.

Vehicle barriers and systems that exclude unauthorized, unwanted, or dangerous vehicles from an area have been known and in use for a number of years. Vehicle barriers that are capable of slowing or stopping vehicles outright are generally either very heavy, bulky, or are permanently installed due to the strength needed to fulfill that role. Thus, such barriers, such as bollards, gates, drop arms, etc., are often by their very nature difficult or impossible to move to previously unprotected areas, while other, less permanent barriers, such as chains, may be incapable of stopping a vehicle.

SUMMARY

An example embodiment is directed to a portable vehicle barrier to prevent passage of a vehicle. The portable vehicle barrier includes a main beam and a plurality of spar assemblies attached to the main beam, the plurality of spar assemblies being spaced apart along the main beam. Each of the plurality of spar assemblies comprises a plurality of spars that are angularly spaced apart from one another and extend outwardly from the main beam. Further, the plurality of spar assemblies may be spaced apart equidistantly along the main beam In one example embodiment, the plurality of spars may comprise a first spar, a second spar, and a third spar. The plurality of spars may radially extend outwardly from the main beam, and be angularly displaced from one another. The spar assemblies in some embodiments may also each comprise a fourth spar, wherein the fourth spar is angularly displaced from the first, second, and third spars. For example, the spars may be spaced 90° apart from one another, and may further or alternatively form an X-shaped structure. Each spar may have a variety of different tips, which may be formed from the spar end or may be removably attached to the spar ends. Further, the tips may have protective or otherwise functional tip covers.

In still another example embodiment, the main beam is hollow and comprises a first end and a second end, and the barrier may further comprise a flexible member inside the main beam, the flexible member being removably attachable to flexible anchor members beyond the first end and the second end to anchor the portable vehicle barrier.

In another example embodiment, the main beam may comprise a central axis along its length, and the plurality of spar assemblies may be rotatably mounted on the main beam, each spar assembly having an extended state and a stored state, wherein the first spar, the second spar, and the third spar of each spar assembly are transverse to the central axis when the spar assembly is in the extended state, and wherein the first spar, the second spar, and the third spar intersect a plane along their length, the plane including the central axis, when the spar assembly is in the stored state, and wherein each spar assembly is rotatable from the extended state to the stored state. The plurality of spar assemblies may be lockable in either the extended state or in the stored state.

In a further example embodiment, the main beam may have a plurality of openings spaced apart along the main beam, and each of the plurality of spar assemblies may comprise a first spar and a second spar that extend through corresponding openings. These spars may each be formed from, for example, a single, straight piece of metal, or they may have an angle formed in them. In some further embodiments, the first spar and second spar of each spar assembly are angularly spaced apart from one another, and the plurality of spars may extend radially through the main beam. In addition, the plurality of spars may be releasably attached to the main beam by a plurality of locking pins that each extend through a spar and the main beam.

In some example embodiments, one or more of the plurality of spars may have a bifurcated tip, or a multi-point tip, such as a tip with two or four sharpened points, protected by a protective tip cover.

There has thus been outlined, rather broadly, some of the embodiments of the portable vehicle barrier in order that the detailed description thereof may be better understood, and in order that the present contribution to the art may be better appreciated. There are additional embodiments of the portable vehicle barrier that will be described hereinafter and that will form the subject matter of the claims appended hereto. In this respect, before explaining at least one embodiment of the portable vehicle barrier in detail, it is to be understood that the portable vehicle barrier is not limited in its application to the details of construction or to the arrangements of the components set forth in the following description or illustrated in the drawings. The portable vehicle barrier is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1A:
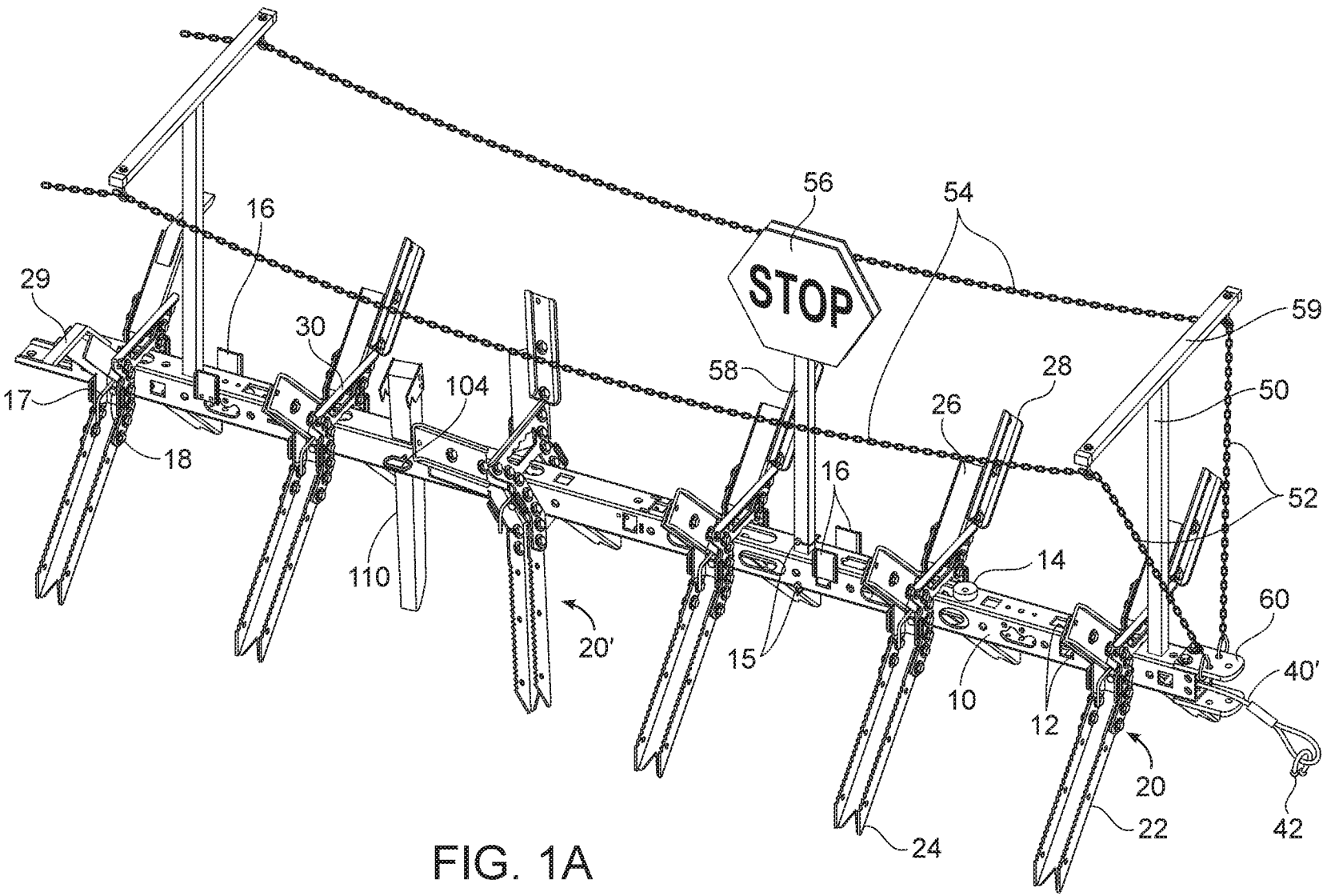
FIG. 1A is a perspective view of a portable vehicle barrier in accordance with an example embodiment.

An example portable vehicle barrier generally comprises a main beam 10 for mounting a plurality of spar assemblies 20 that comprise a plurality of spars 22 that generally radially extend away from the main beam 10. One example embodiment of the portable vehicle barrier is shown in FIG. 1A. In this embodiment, the spar assemblies 20 each form an X-shaped structure. As shown, the spar assemblies are in their extended, or deployed, state, in which, as mentioned above, each spar extends away from the beam.

The spar assemblies 20 may include four spars that extend away from the main beam 10. In one possible example embodiment, the spars may be formed from pairs of elements, which may be bent to produce two spars 22 from a single piece of metal. Two such pieces, once formed into spars 22, may be attached together by spar plates 30 to form an X-shaped spar assembly 20 having a total of four spars 22 that, when the spar assembly is in the extended state, each extend away from the main beam 10. In an example embodiment, each spar 22 may be angularly spaced at 90° from its adjacent spars, although other angles are possible as well. In addition, spar assemblies having more or fewer than four spars are also possible.

In example embodiments, individual spars, or spar assemblies, may be spaced equidistantly along the main beam 10. In an X-shaped configuration, with any four spars (such as with a four-spar assembly), two spars will extend down from the main beam 10 and support the beam horizontally across a path, while the other two spars will extend upward, so as to engage a vehicle approaching the barrier from either direction. As shown generally in the figures, in the X-shaped configuration, the spar assemblies 20 are substantially symmetrical with respect to a vertical plane intersecting the main beam 10 along its length. This symmetry need not be perfect, as hardware and other constraints may dictate slight differences. However, the symmetry ensures that the barrier is equally effective at stopping or impeding vehicles approaching from either direction.

In addition to an X-shaped spar assembly 20, where the spars themselves are connected, the vehicle barrier may also have spar assemblies with spars made from a single piece of metal, where each side of the spar extends through the main beam on either side, comprising a spar 110 with two ends 112, 114, extending through an opening 12 or 101 on the main beam 10, and locked in place on the main beam 10 with a locking pin such as handled locking pin 104. Such a spar may be straight or may have an angle, such as a central angle, so that each end forms an outward-extending spar 22 at a different angle to the main beam 10. Any spar usable with the vehicle barrier may also include a bolt-on spar tip 28, which may take any of several different forms. Such spar tips may be attached to either end of a spar, such as ends 24, 26, 112, or 114. The spar tips 28 may be designed and shaped to engage the ground, or to engage the underside of a vehicle as it moves into or toward the barrier, generally in a path transverse to the main beam 10.

In the embodiment of FIG. 1A, the spar assemblies 20 may be rotatably mounted on the main beam 10, and may be rotated about a pivot bolt 18 that extends through the main beam 10. Each spar assembly 20 may be locked in place as shown for example in FIG. 1A by a locking pin 17, which may be generally L-shaped so as to fit closely within the spar assembly 20. The straight end of locking pin 17 may have a locking ball or a hole for a pin, such as an R-spring pin, to retain the locking pin 17 in position once it is inserted through a spar assembly 20 and the main beam 10.

In addition being lockable in the extended state, the spar assemblies 20 can be rotated and locked in a stored state, and similarly locked in position with locking pins 17. To do this, the locking pins 17 can be inserted through different sets of holes or openings in main beam 10, which will generally be angularly spaced 90° apart, and centered on a hole for pivot bolt 18 in the main beam 10. In some example embodiments, the main beam 10 may be a hollow square or rectangular metal tube. For example, the main beam may be made of steel, aluminum, or any number of suitable metals. The main beam 10 may also have a number of openings and holes for the attachment and mounting of various accessories. For example, a stop sign 56 may be mounted on the main beam 10 by inserting a support post 58 into an opening 12 of main beam 10 and locking it into place with bolts, or with releasable locking pins 15.

Any number of accessories may be similarly mounted, such as a pedestrian barrier chain 54 mounted with support post 50 and support beam 59 and support chains 52. A warning light, such as a flashing light 120 may also be similarly mounted on the vehicle barrier. Further, an informational or warning banner 122 may be mounted to extend along the length of the main beam 10 using a support post 124 and bungee cords 126, or other mounting devices.

Figure 11:
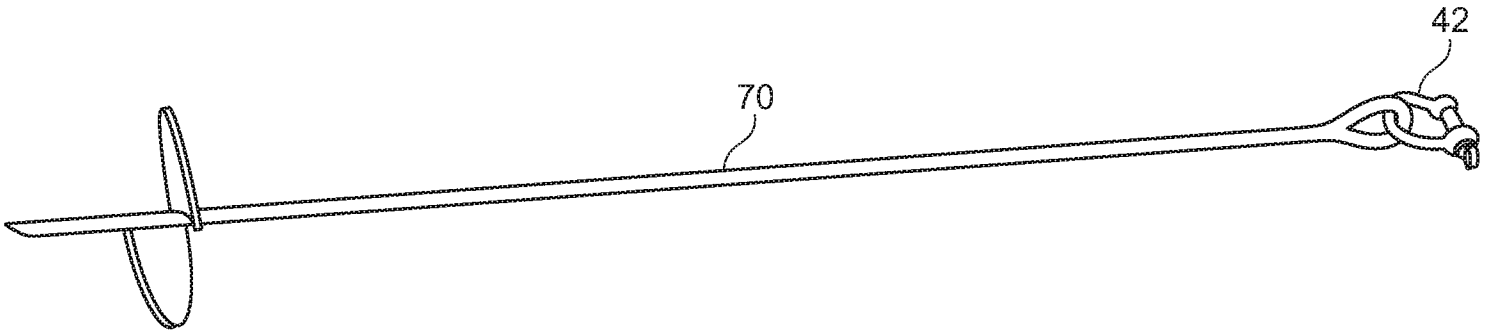
FIG. 11 is a perspective view of a ground auger usable to anchor a vehicle barrier in accordance with an example embodiment.
Figure 23B:
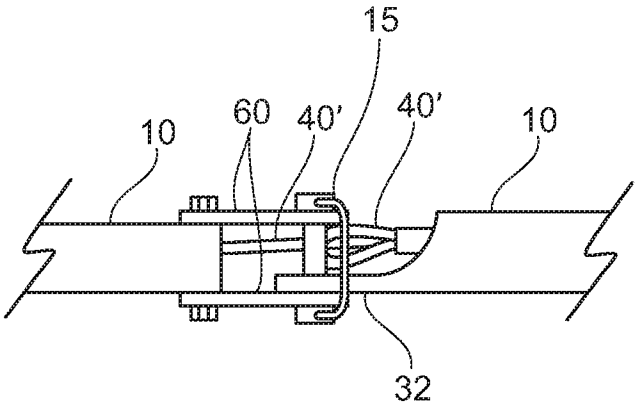
FIG. 23B is a side view of end components of two coupled vehicle barriers in accordance with an example embodiment.
Figure 23A:
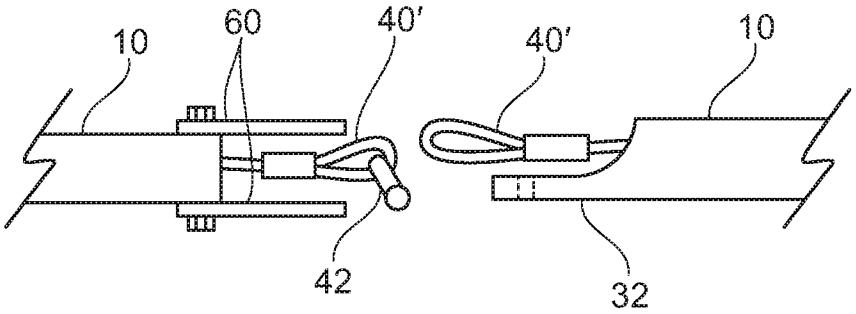
FIG. 23A is a side view of end components of two uncoupled vehicle barriers in accordance with an example embodiment.
Figure 25:
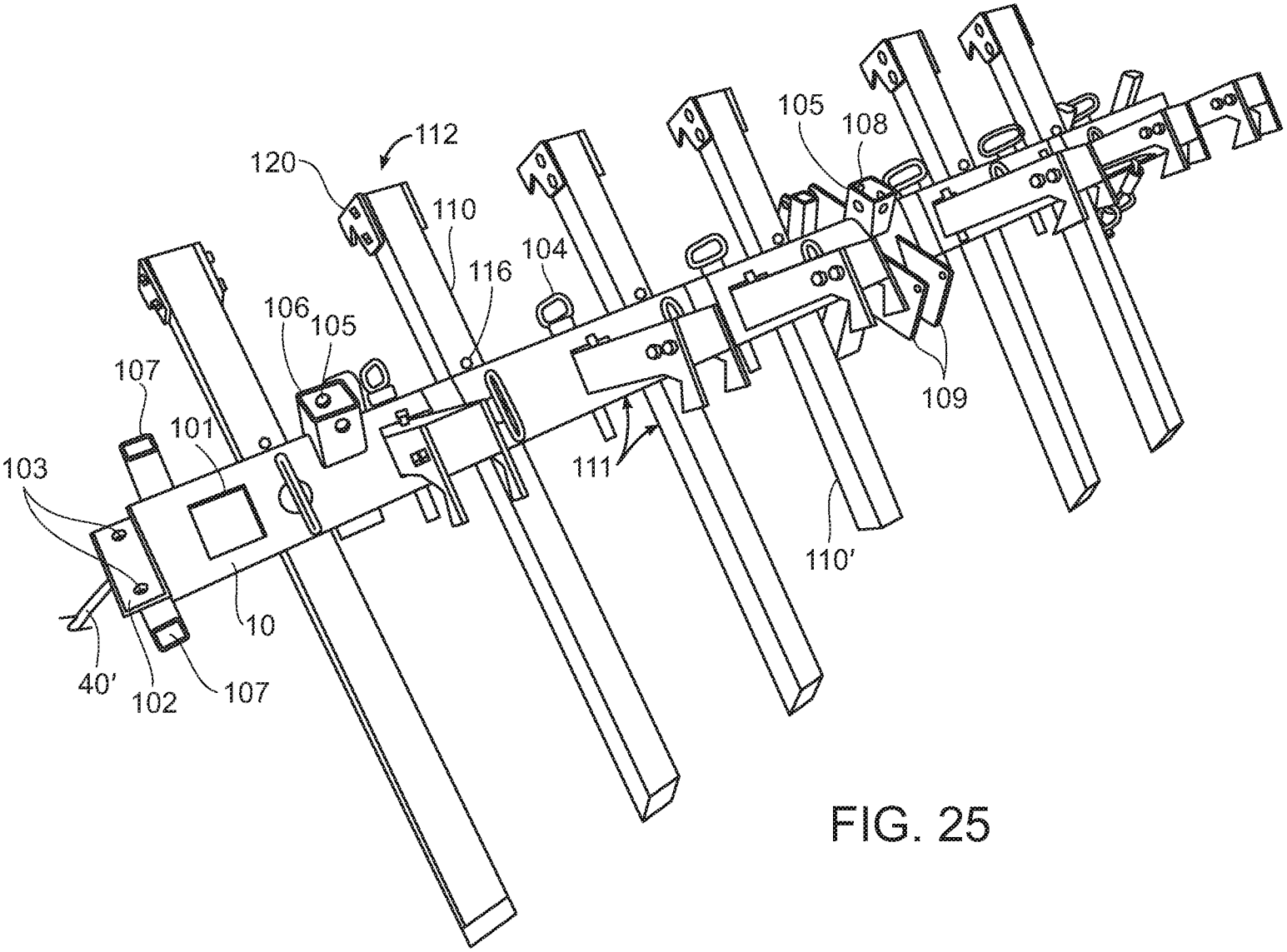
FIG. 25 is a perspective view of an alternative example embodiment of a portable vehicle barrier.

Use of a hollow main beam 10 also allows for a flexible member 40', such as a steel cable or a chain, to be inserted through the length of the main beam 10. Such a flexible member 40' may serve several purposes. For one, it may be used to aid in coupling any number of vehicle barriers together, to in effect create one long barrier. In such a case, the flexible member 40' of multiple barriers may be joined together with a shackle 42 near the ends of two main beams 10. The flexible members 40' may be used in addition to other couplers, such as hammer strap 60 and tang 32 which can be held together with a locking pin 15. Details of such a coupling are shown in FIGS. 23A and 23B. Further, shackles 42 or other devices/couplers may be used to connect the flexible member or members 40' within a main beam 10 to an anchoring flexible member 40" which is in turn connected to an anchor 70, such as a screw-in ground auger. By using two anchors 70 at each end of a vehicle barrier or coupled, multiple barriers, the vehicle barrier can be held in place to more effectively slow or stop a moving vehicle. FIG. 11 illustrates a ground auger 70 and a shackle 42, prior to installation. In some embodiments, such as a heavy-duty embodiment, the spar assemblies may comprise individual, linear or angled spars 110 that extend through openings 101 in a heavy-duty main beam 10, as shown, for example, in FIG. 25. In this embodiment, the main beam 10 may also be a hollow, rectangular steel or metal beam, which allows for a great deal of flexibility in configurations and components that can be mounted on the beam. As shown in FIG. 25, for example, the main beam 10 may be in a generally diagonal position relative to the ground, so that individual spars 110 will extend through the main beam 10 at an angle to the ground, such as a 45° angle. Similarly, adjacent spars 110 that make up a spar assembly may be at right angles to each other, although other angles are or course possible. The spars 110 in this embodiment will generally have two ends 112 and 114, and may also extend radially outward from the main beam 10.

B. Main Beam

As best shown in FIGS. 1A and 25, the example embodiments of the portable vehicle barrier include a main beam 10, which may be an elongated hollow metal beam. When the barrier is deployed, the main beam 10 will be positioned above a road, path, etc. in a horizontal attitude as shown. The main beam 10 is supported horizontally above the ground or road by generally downward-angled spars when the barrier is in an initial position. For example, in the embodiment of FIG. 1A, the main beam 10 is supported by two downward-angled spars 22 of each spar assembly 20. In the embodiment of FIG. 25, which is generally a heavy-duty vehicle barrier, the main beam 10 is supported by the downward-angled spars 110.

Figure 1B:
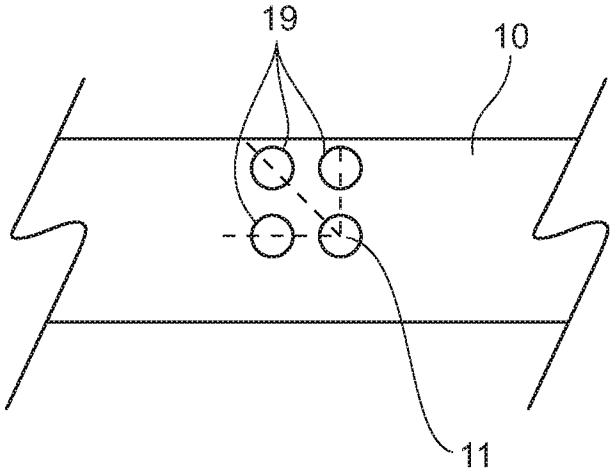
FIG. 1B is a detail view of a main beam of a vehicle barrier in accordance with an example embodiment.
Figure 14:
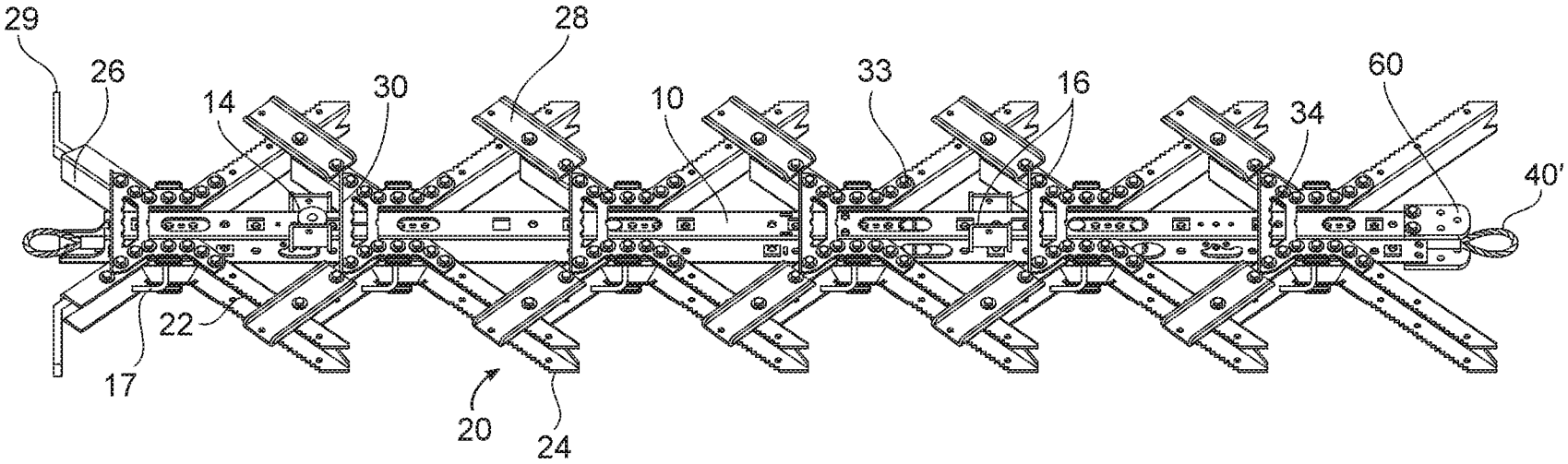
FIG. 14 is a perspective view of a vehicle barrier in a stored state in accordance with an example embodiment.
Figure 18:
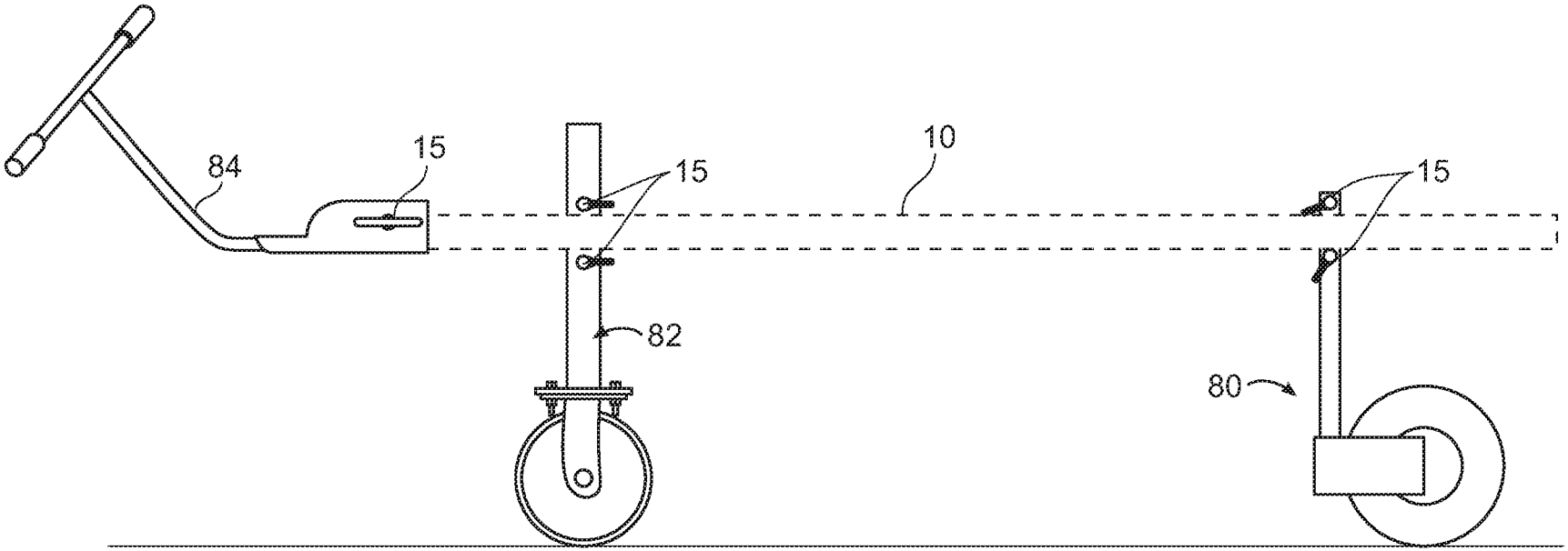
FIG. 18 is a side view of a vehicle barrier highlighting several transport components in accordance with an example embodiment.
Figure 20:
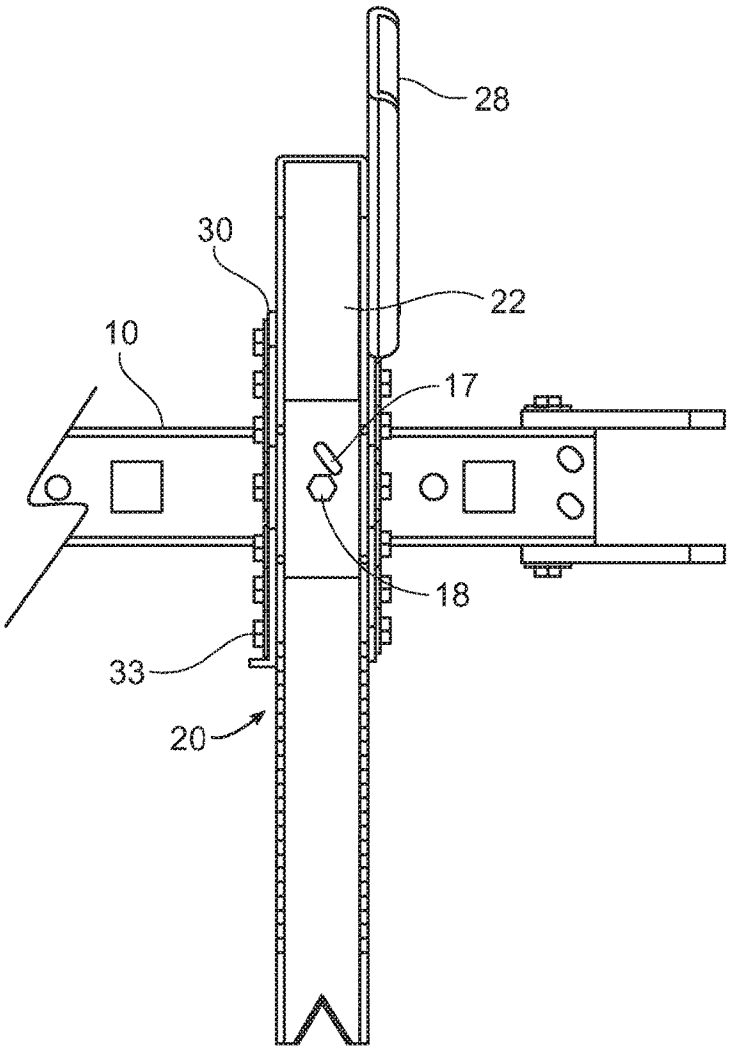
FIG. 20 is a side, detail view of a spar assembly mounted on the main beam of a vehicle barrier in accordance with an example embodiment.

The main beam 10 has a plurality of openings 12 and holes used for mounting various elements and components of the vehicle barrier. For example, as shown in FIG. 1B, the main beam 10 may have, for mounting each spar assembly 20, a pivot bolt hole 11, and two or more locking pin holes 19. As shown, the locking pin holes 19 are generally angularly spaced apart by 90°, which allows the spar assemblies 20 to be rotated about pivot bolt 18 and locked in place with locking pin 17 in either an extended (deployed) state as shown in FIG. 1A, or in a stored state, in which the spar assemblies 20 are generally flat alongside the main beam, as shown in FIG. 14. In addition, a locking pin hole may be located at a 45° angle from the pivot bolt hole 11, as shown in FIG. 18. This allows a spar to be placed in an extended state at an angle to the beam that is between the other extended position and the stored position. A spar assembly in this position is shown as item 20' in FIG. 1A. Angles other than 45° are also possible. FIG. 20 illustrates in greater detail a spar assembly 20 locked in the extended position on a main beam 10.

The main beam 10 may also have square or rectangular, or circular openings 12 which allow for the installation of various accessories. For example, a stop sign 56 may be mounted on the main beam 10 by inserting a support post 58 into an opening 12 of main beam 10 and locking it into place with bolts, or with releasable locking pins 15. Most accessories and components attached to or mounted on the main beam 10 can be attached or held in place with various types of locking pins, which allows for quick assembly, disassembly, storage, or reconfiguration of the barrier. In addition to a stop sign, FIG. 1A shows a pedestrian barrier chain 54, which is also supported by a support beam 59 and support post 50 which is inserted into and locked in place on the main beam 10 with locking pins 15 for quick removal and installation.

Figure 13:
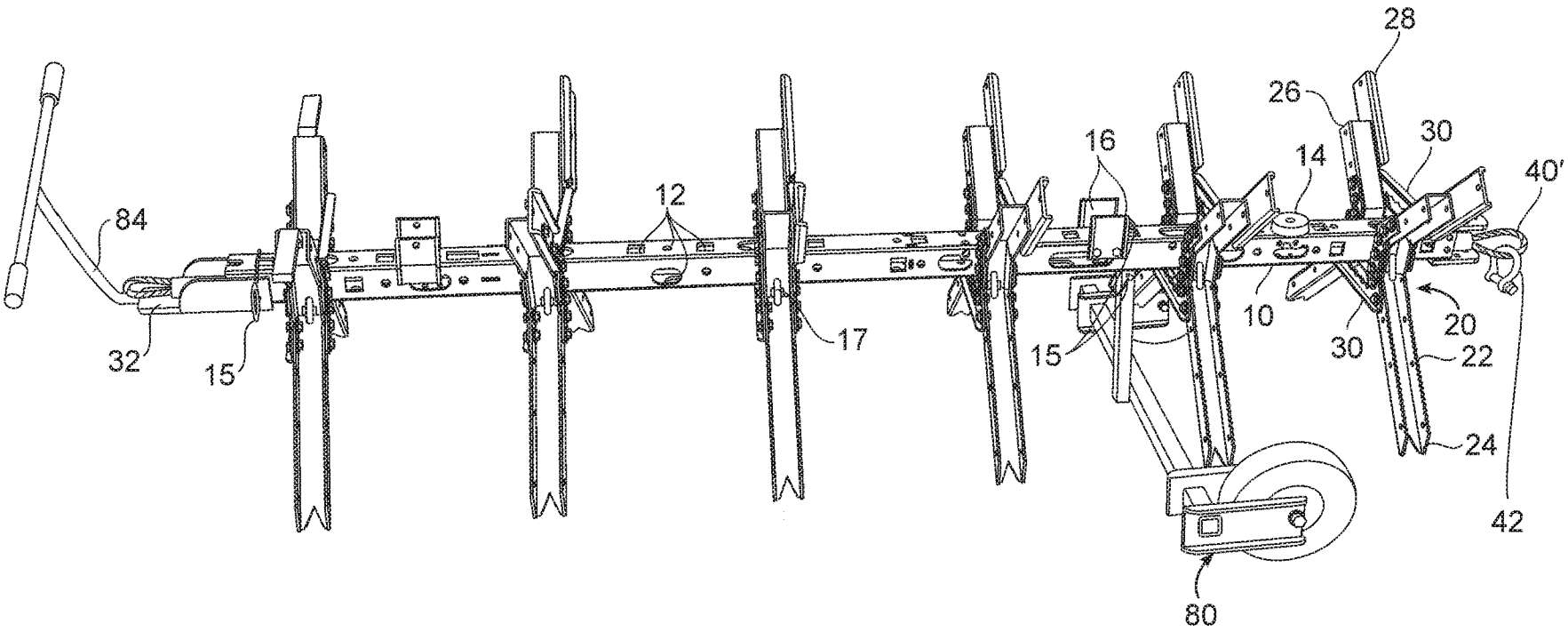
FIG. 13 is a perspective view of a vehicle barrier with transport components in accordance with an example embodiment.
Figure 19:
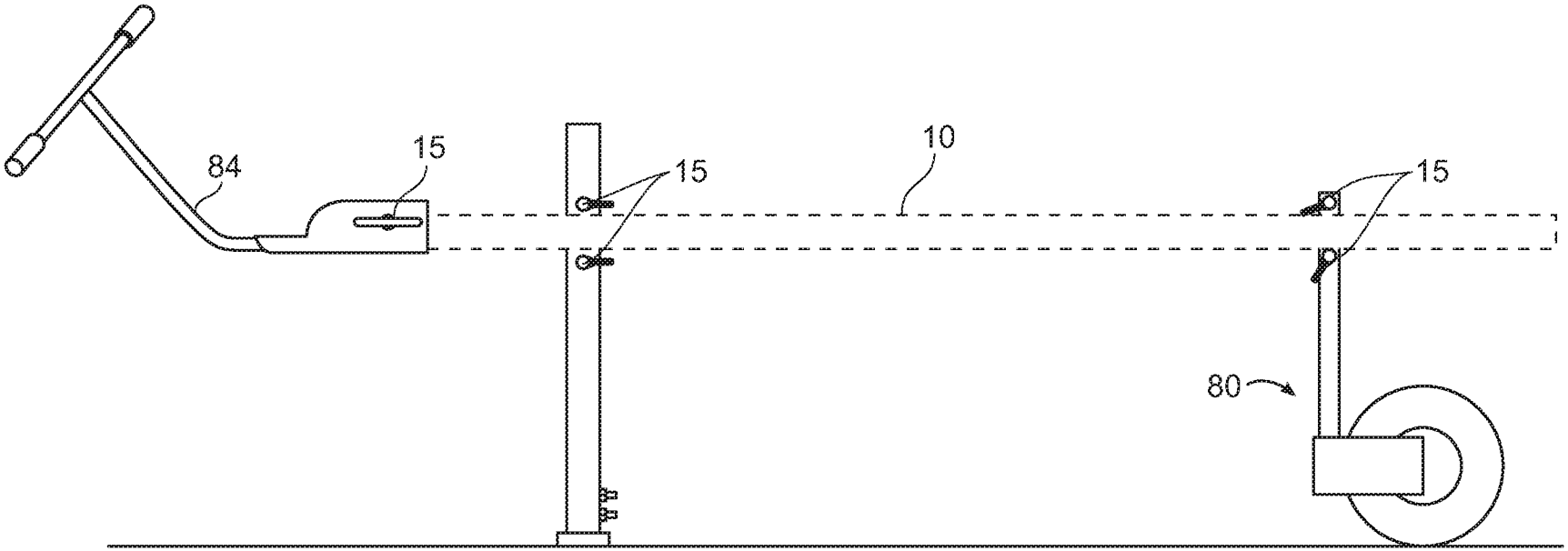
FIG. 19 is another side view of a vehicle barrier highlighting several transport components in accordance with an example embodiment.

As best shown in FIGS. 13, 18 and 19, the openings 12 may also be used to mount various components of an optional transport kit for towing or manually relocating the vehicle barrier. The main beam 10 in this figure is shown in outline and without other typical components to highlight the components of the transport kit. The transport kit may include an axle/tire assembly 80, a handlebar 84, and a caster 82 or alternatively, a drop leg 82'. For ease of transport and positional adjustment, any of the wheels, such as caster 82, may rotate 360° about a vertical axis. All of these transport components may be inserted through the openings 12 in main beam 10 and locked in place with locking pins 15, with two locking pins simply extending through the mounting portions of components (80, 82, 82') on either side of the main beam 10 to hold them in place. The handlebar 84 can be easily held in place with a single locking pin 15 inserted horizontally through a portion of the handlebar and a matching horizontal hole in one end of the main beam 10, as shown.

Figure 17:
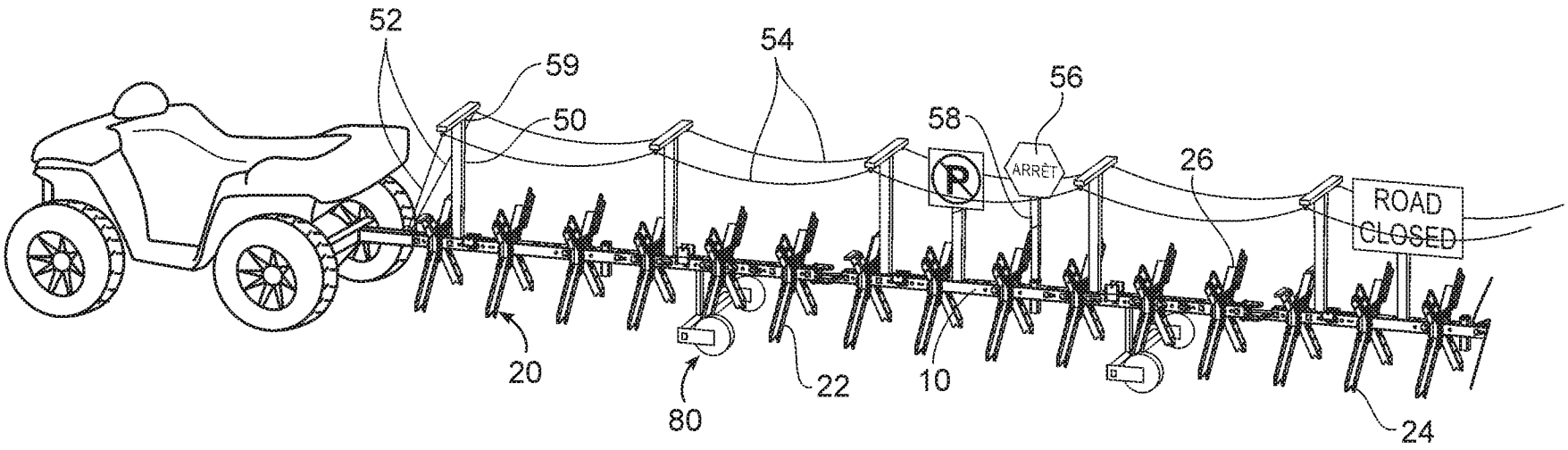
FIG. 17 is perspective view of multiple, coupled vehicle barriers with transport components in accordance with an example embodiment.
Figure 30:
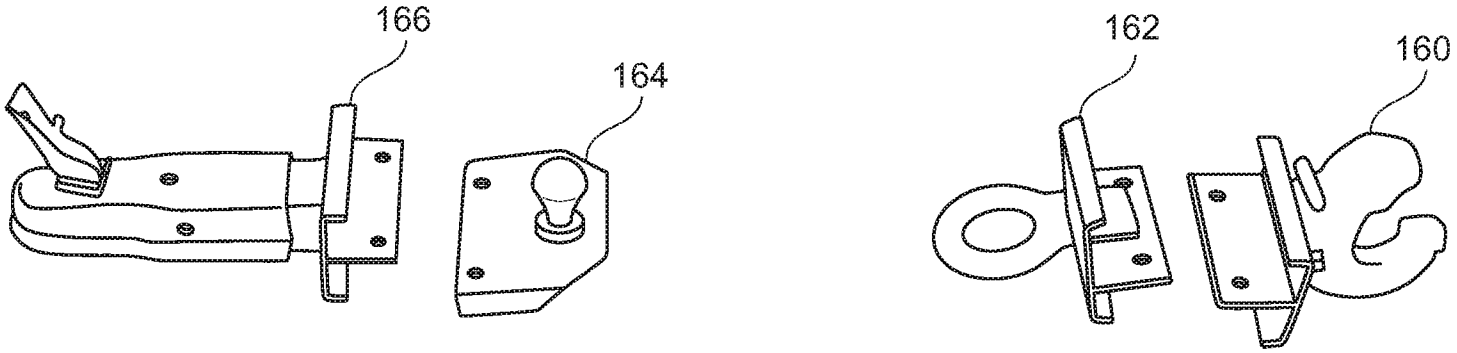
FIG. 30 is a perspective view of transport couplings of a portable vehicle barrier in accordance with an example embodiment.
Figure 31:
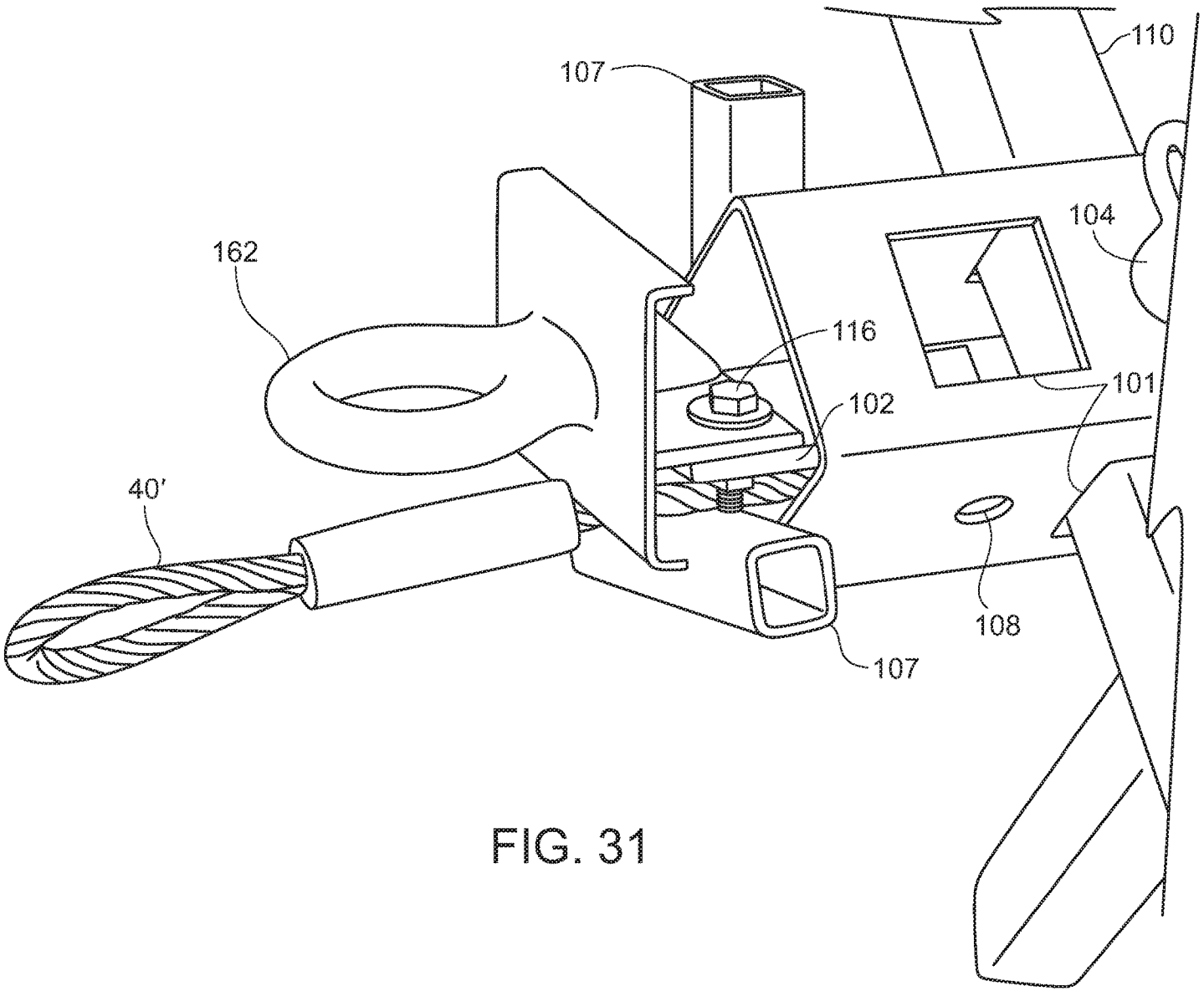
FIG. 31 is a detail perspective view of a transport coupling mounted on a portable vehicle barrier in accordance with an example embodiment.

In lieu of a handlebar, the main beam 10 may have a towing coupling, such as shown in FIG. 30, for example. The couplings 160, 162, 164, and 166 may be adapted to fit either the larger, heavier main beam 10 of the heavy-duty embodiment, or the lighter, smaller main beam 10 of the standard duty embodiment. FIG. 31 illustrates detail of coupling 162 attached to mount 102 on main beam 10, attached by bolts 116. Any of the different coupling types 160, 162, 164, and 166 may be similarly mounted for towing barriers in various configurations. If a towing coupling is used, a tow vehicle will hold up the end of the main beam 10, so only one assembly, such as axle/tire assembly 80, will typically be needed for each beam. Further, multiple units can be coupled together and staged in one area, and then quickly towed to another area by a tow vehicle, as shown in FIG. 17. As also shown, each main beam 10 includes an axle/tire assembly 80 for towing, without a front caster. In any embodiment, the wheel assemblies may include a vertical support strut that has multiple holes, so that the height of the assembly, and thus the height of the main beam, can be adjusted as desired by raising or lowering the beam and inserting a locking pin 15 to maintain the height.

Figure 27:
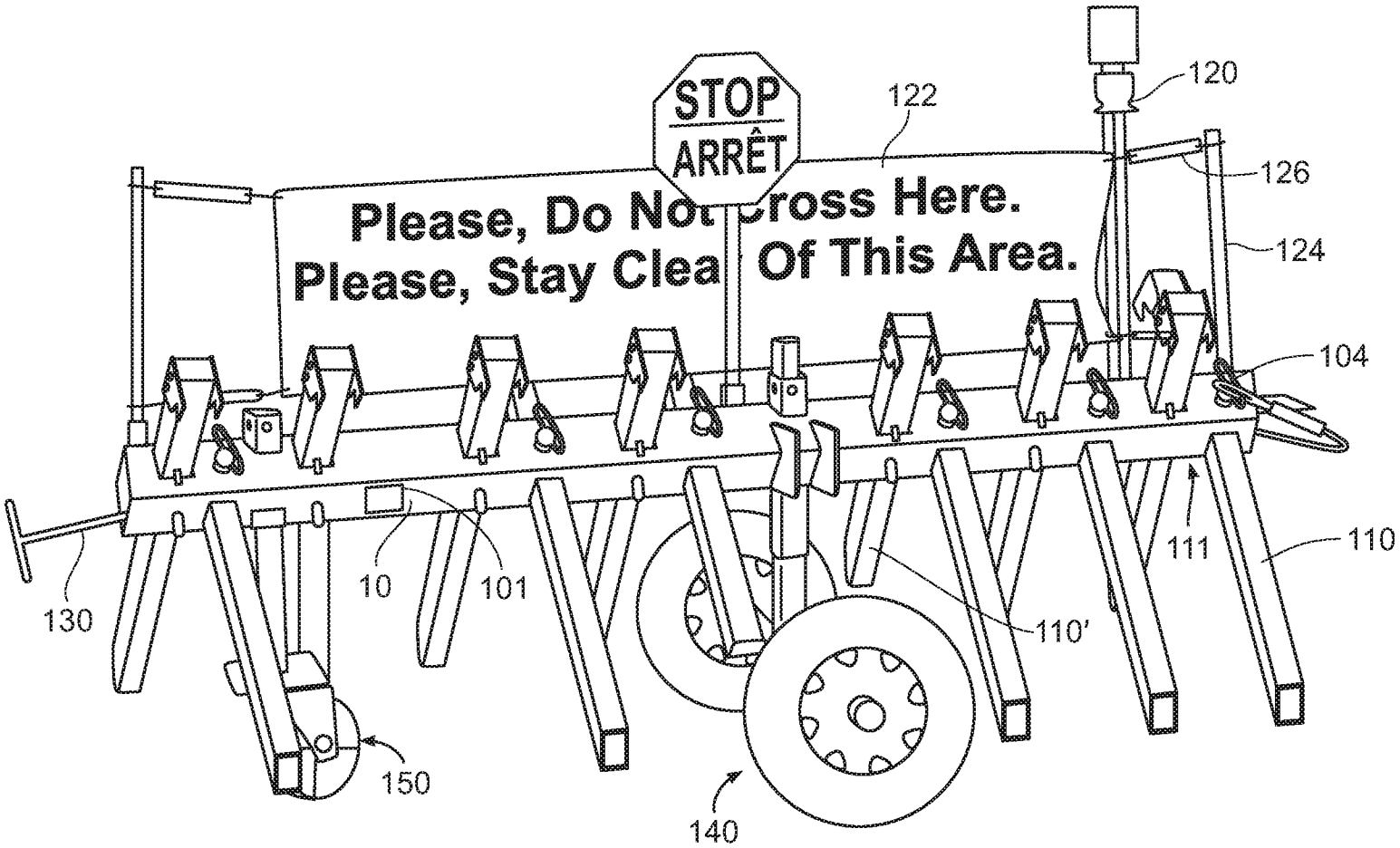
FIG. 27 is another perspective view of an alternative example embodiment of a portable vehicle barrier.

As shown in FIG. 25, the heavy duty embodiment of the main beam 10 may include a number of mounting fixtures, rather than simple openings. This may be needed for example if the main beam 10, when horizontally positioned, has a diagonally-oriented square cross section. Examples of the mounting fixtures are large mounting fixtures 106, 108 and small mounting fixture 107. The small mounting fixtures 107 may be used for mounting accessories to the beam, as shown in FIG. 27. The large mounting fixtures 106, 108 may be used for attaching or mounting wheel assemblies for transport, such as height-adjustable wheel assembly 140 and height-adjustable caster 151. So assembled, the heavy-duty barrier can be pulled by handlebar 130, which may have an "L" shape, with a cross bar insertable into mounting fixture 107.

Figure 26:
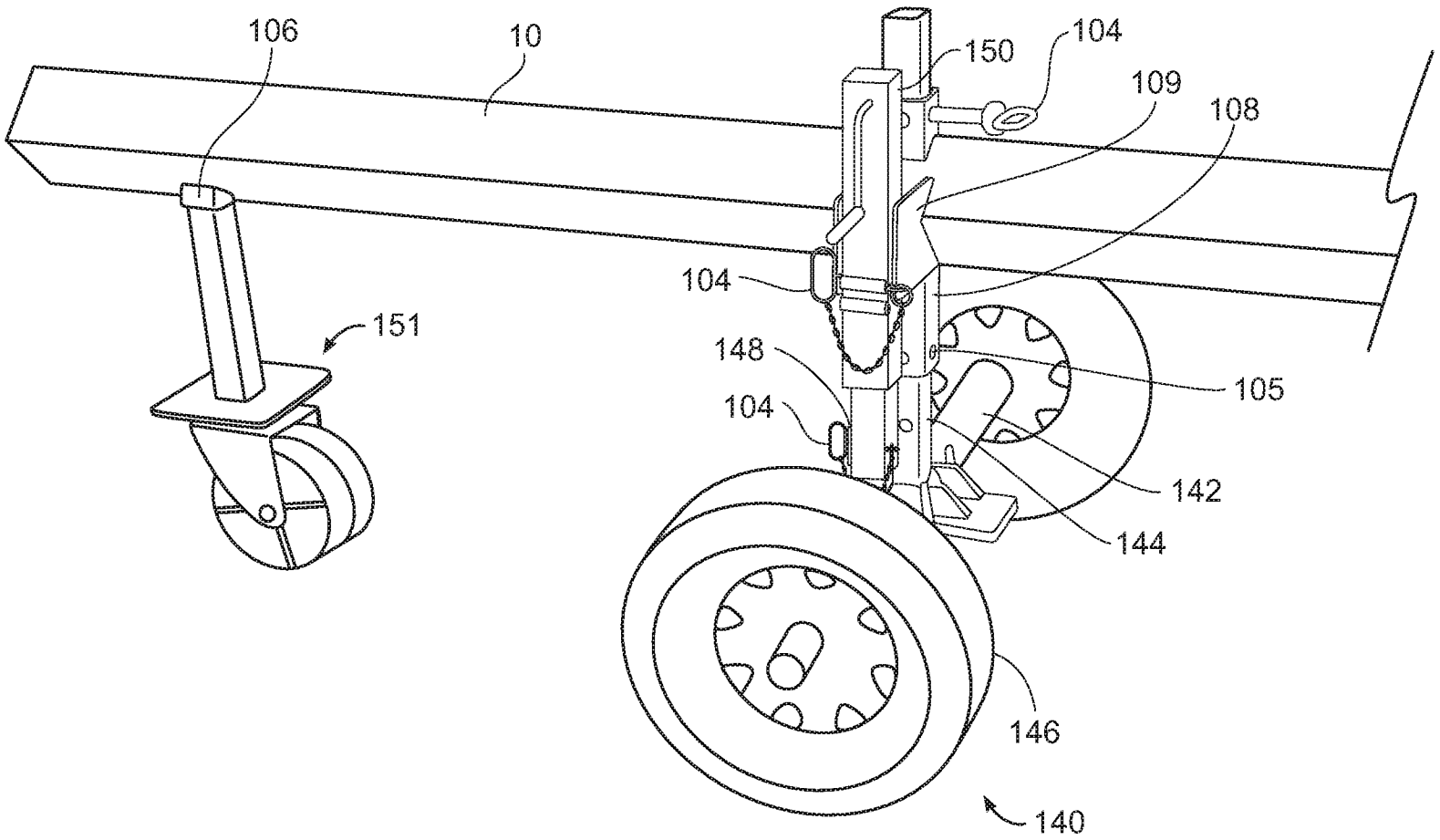
FIG. 26 is another perspective view of an alternative example embodiment of a portable vehicle barrier.

FIG. 26 shows the wheel assemblies in more detail. Wheel assembly 140, which comprises wheels 146, axle 142, and strut 144, is inserted through a mounting fixture 108. Its height may be adjusted by first using jack 150 to move to a desired height, and then a locking pin 104 can be inserted through any of multiple holes in strut 144 and mounting fixture 108 to set the height. At this point, the jack 150 can be removed to prevent unauthorized or unwanted use or transport of the barrier (for example, if the wheels are lifted off the ground). Caster 151 can be similarly adjusted for height by insertion of a locking pin through holes in the strut and the mounting fixture 106 (see FIG. 27). For easily positioning the barrier, caster 151 may be rotatable about a vertical axis.

Figure 29:
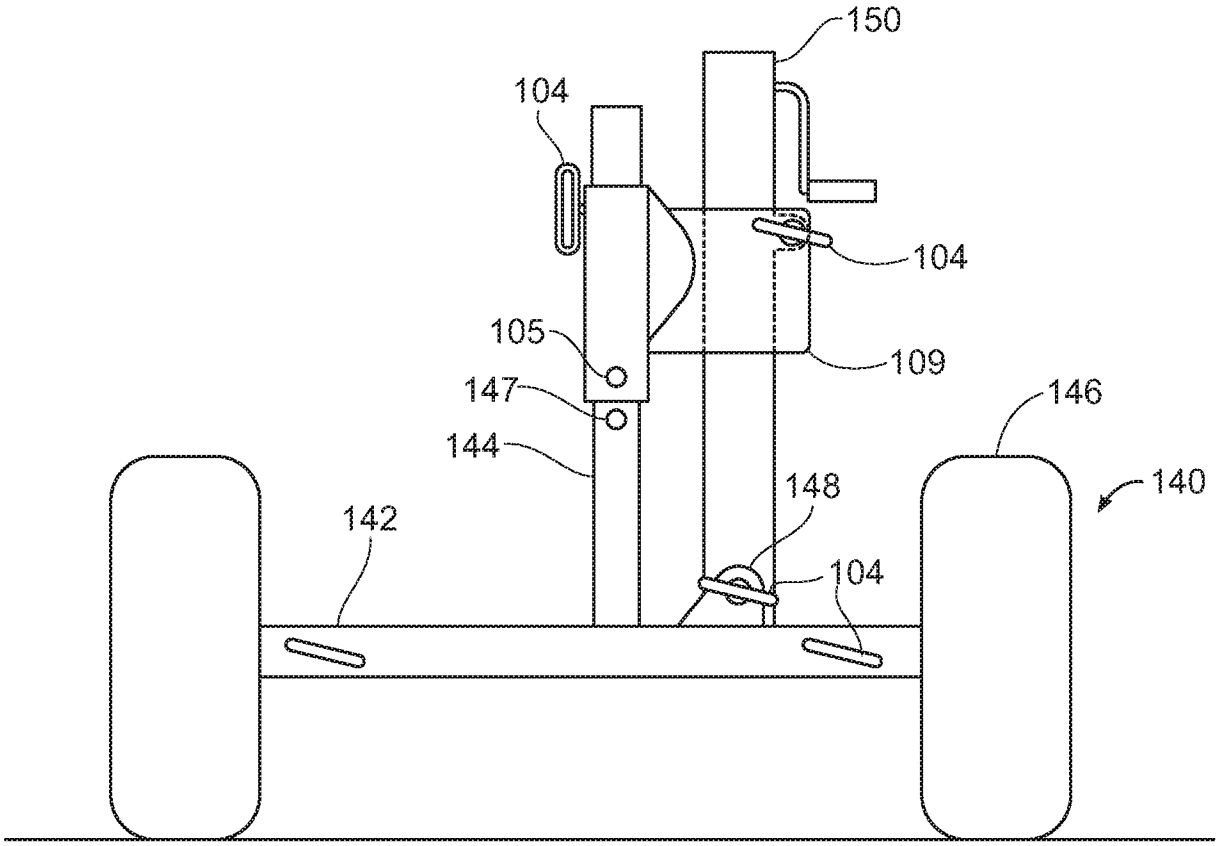
FIG. 29 is an end, detail view of a transport assembly of an alternative example embodiment of a portable vehicle barrier.

As discussed above, and shown in FIG. 25, the wheel assemblies are generally locked at a certain height by inserting locking pins 104 through holes 105 in mounting fixtures 106, 108 and through hole 147 in the strut 144 of the height-adjustable wheel assembly 140 and through height-adjustable caster 151. As will be described in detail below, the heavy duty barrier may have a jack 150 (such as a screw-type jack) to aid in raising and lowering the main beam for transport or placement. The jack 150 can be attached with handle-type locking pins 104, or other kinds of locking pins or bolts, one end to ears 148 of wheel assembly 140, at the bottom, and to jack tabs 109 on the main beam, as shown in FIG. 29. For security reasons, the jack 150 can be removed after the height of wheel assembly 140 is adjusted and locked, to help prevent transport by unauthorized users. Also for preventing the unauthorized movement of a barrier, the jack 150 can be used to lift the wheel assembly up, thus lowering the barrier into position. With the wheels lifted off the ground completely, the wheels may be removed from the assembly, so that even if the jack were used by an unauthorized person to raise the barrier, the barrier could not be moved with the wheels. The wheels may be inserted into the wheel assembly using locking holes in both the assembly and the wheel axle, and locking the wheels in place with a locking pin 104, as shown in FIG. 29. For purposes of clarity only, jack tabs 109 are only shown on one side of the main beam 10, but they will typically be on both sides, so that jack 150 can in turn be attached to either side of the main beam 10.

The main beam 10 may also have a plurality of openings 101 spaced apart along the main beam 10, as shown in FIG. 25. These openings may be square or rectangular, round, etc. Each opening 101 may be used to receive two spars 110, which may be formed from a single, straight or angled piece of material, such as steel, wherein each spar 110 extends from each side of the main beam 10. In this configuration, any adjacent set of four spars 110 may comprise a spar assembly 111, and further, the spars 110 or spar assemblies 111, may be spaced equidistantly apart from one another along the length of the main beam 10. Each of the plurality of spar assemblies 111 may comprise a first spar 110 and a second spar 110 that extend through corresponding openings 101 in the main beam 10. As shown, the first spar 110 and the adjacent second spar 110 of each spar assembly 111 are angularly spaced apart from one another, and thus any two adjacent sets of spars 110 (comprising four spars) may, as with other embodiments, form an X-shape.

As also described above, the X-shaped assembly may typically comprise two spars below the main beam 10, which support the beam in a horizontal position, and two spars above the main beam and angled upward to either side of the beam, so that one spar of any two upward-facing spars will always face a vehicle approaching the barrier when the barrier is deployed across a path, road, etc. The plurality of spars may extend radially through the main beam. In addition, the plurality of spars 110 may be releasably attached to the main beam 10 by a plurality of locking pins 104 that each extend through a spar and the main beam.

C. Spars

Figure 8:
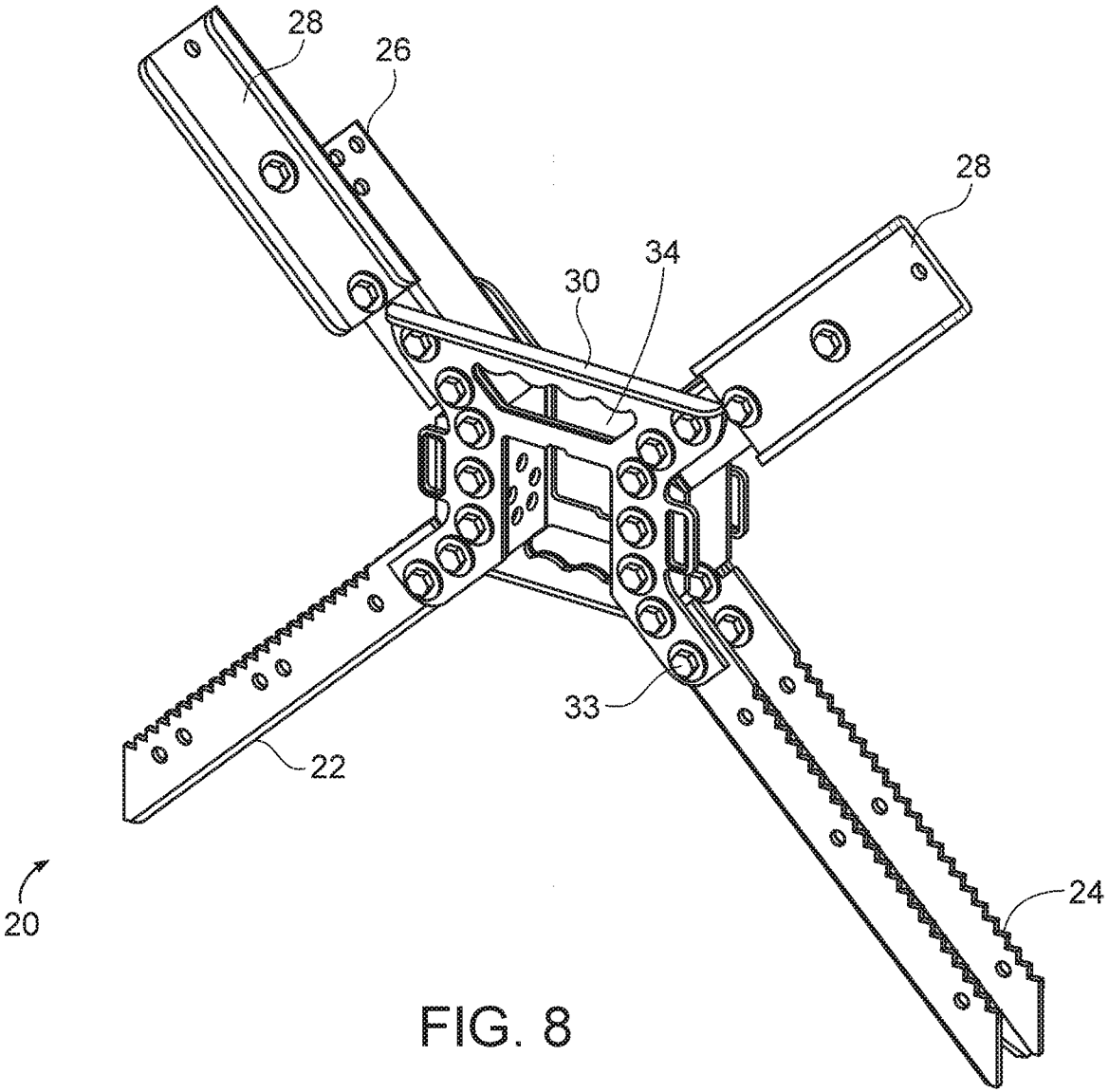
FIG. 8 is a perspective view of a spar assembly of a vehicle barrier in accordance with an example embodiment.
Figure 15:
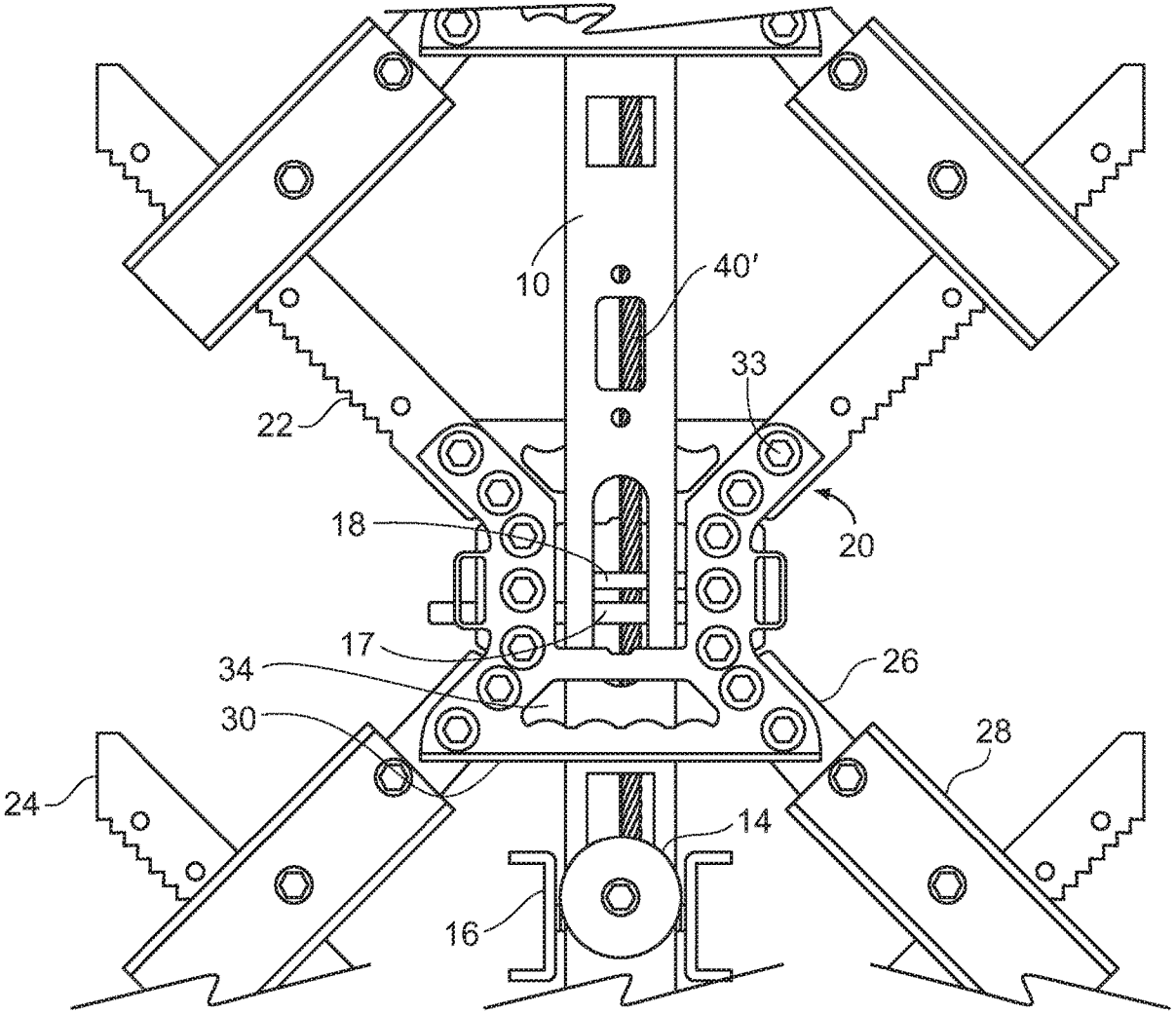
FIG. 15 is a top view of a vehicle barrier in a stored state in accordance with an example embodiment.
Figure 24:
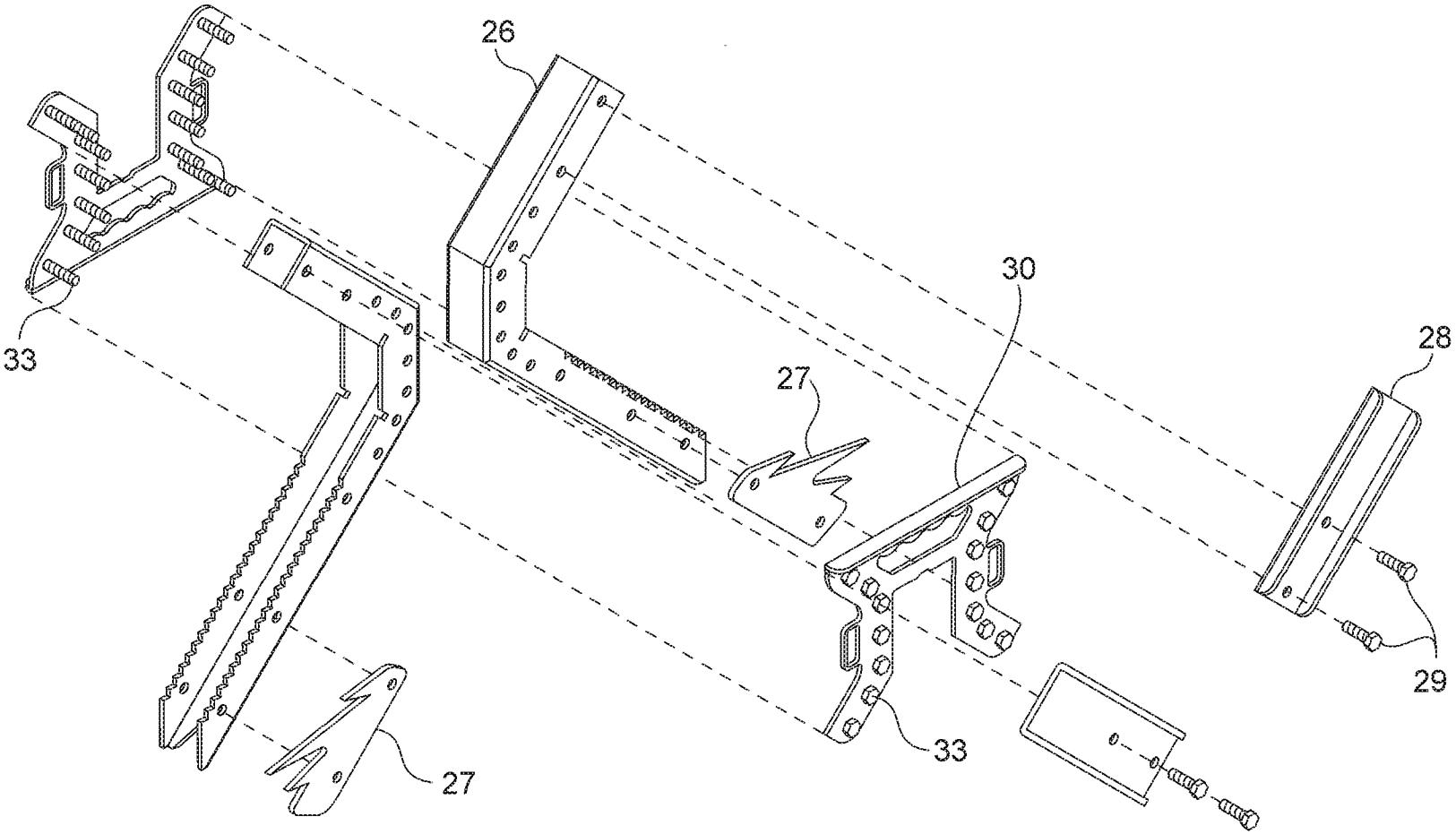
FIG. 24 is an exploded view of a spar assembly of a portable vehicle barrier in accordance with an example embodiment.

As best shown in FIGS. 1A and 25, the example embodiments of the portable vehicle barrier include a plurality of spars that, in some example embodiments, form an X-shaped spar assembly 20 (standard duty) or 111 (heavy duty). Details of standard-duty spar assembly 20 are shown in FIGS. 8 and 24. Each side of the spar assembly, comprising two spars 22, can be formed from a single, bent piece of metal, as shown, forming half of the X-shaped structure of the final spar assembly 20. Each side of the assembly is bolted to a spar plate 30, using bolts 33. As also shown, the spar plates 30 may form be "U" shaped, so that, by attaching spar halves as shown (i.e., with the two spar plates rotated relative to each other), the spar assemblies can be rotated between an extended position and a stored position, because the openings in spar plates 30 allow the main beam 10 to pass through the spar plates until the spars 22 are substantially aligned with the main beam 10. When rotating spar assemblies 20 into the stored state or position, the portion of the spar plates 30 in the space between the spars 22 will contact the main beam 10 and stop the rotation, as shown in FIGS. 14 and 15. In this position, locking pins 15 can be used to lock each spar assembly 20 in the stored position.

As shown in FIG. 1A, the spar ends 24 that, in an initial position will be in contact with the ground or a road, may have bifurcated or multi-point tips so that the spars will dig into the ground or pavement when a vehicle runs into the barrier. These tips are shown formed at end 24 of spar 22, for example in FIG. 24. In addition, the pointed tips will also increase the likelihood that the spars will puncture and damage a vehicle if the barrier rotates as a car passes over it, as will be explained in more detail below. Also, the spars 22 may have any of numerous different removable/interchangeable spar tips bolted or screwed onto them, as also shown in FIG. 24. These longer tips will typically be mounted on the ends 26 of spars 22 that will be upward facing when the barrier is in its initial position. A flat, vehicle-engaging tip 28 is shown attached to the upper spars 22 in FIG. 1A and FIG. 24, attached by bolts 29.

Figure 10:
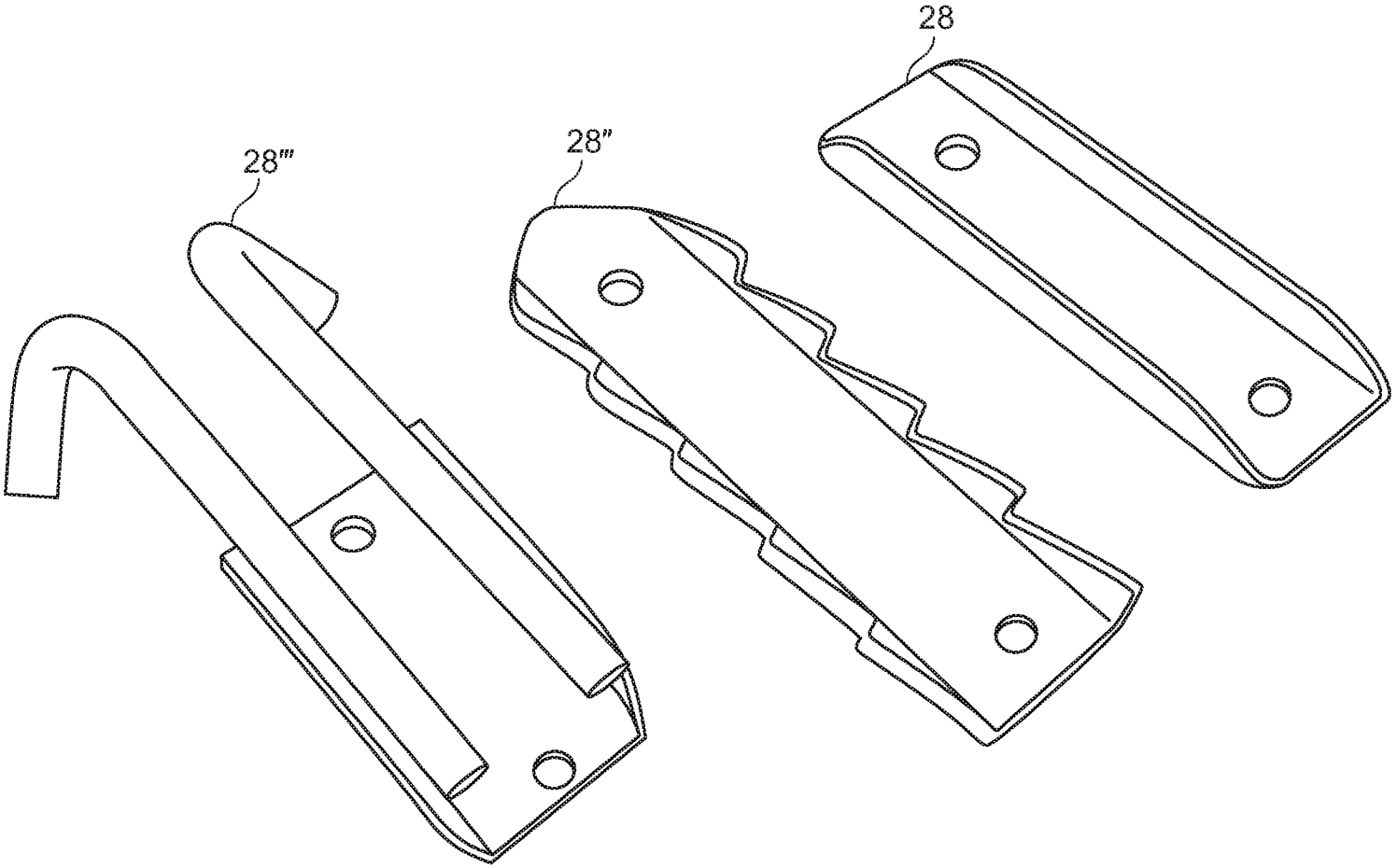
FIG. 10 is a perspective view of embodiments of removable spar tips in accordance with an example embodiment.
Figure 32:
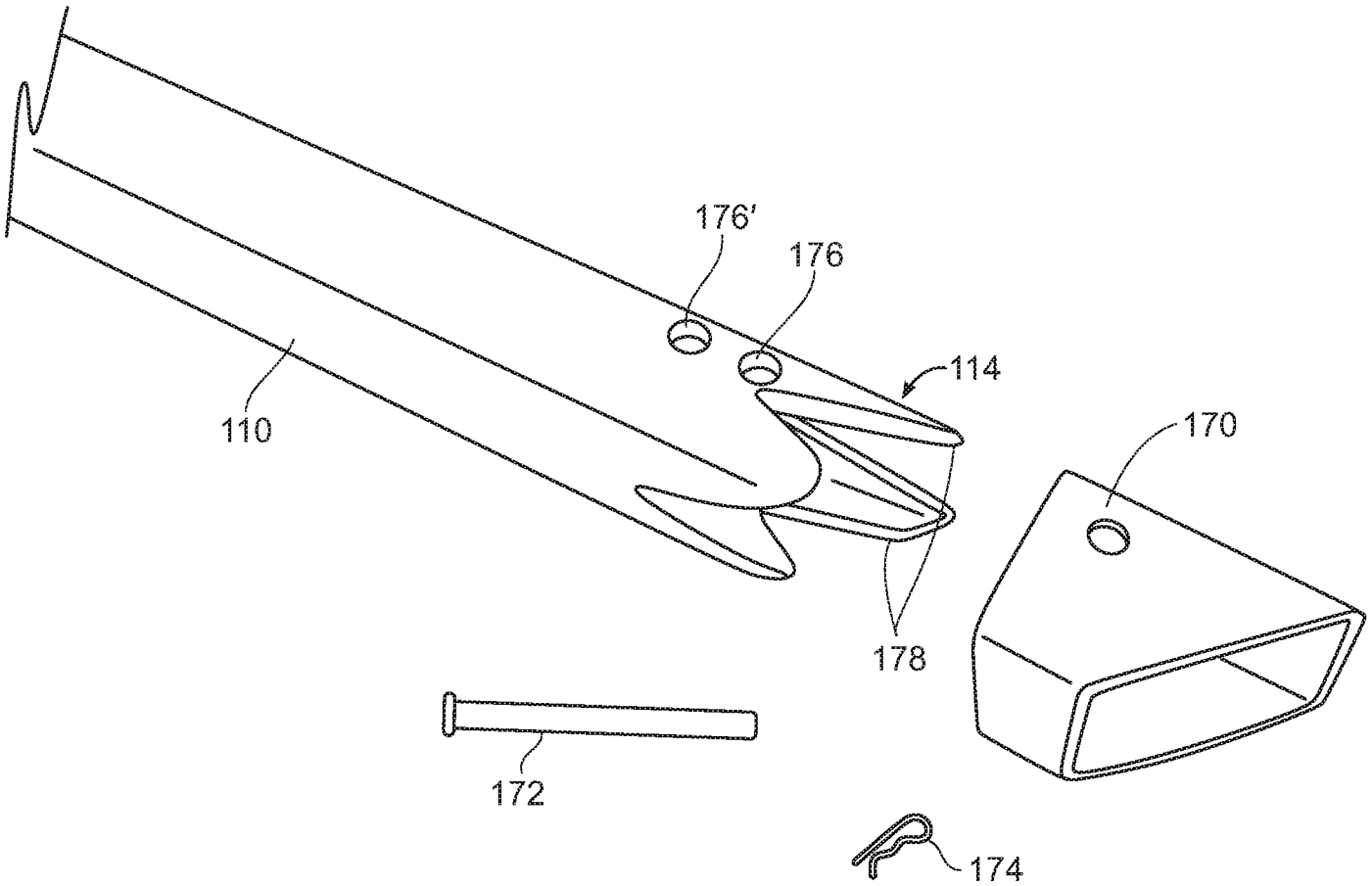
FIG. 32 is a detail perspective view of a spar tip and a tip cover of a portable vehicle barrier in accordance with an example embodiment.
Figure 33A:
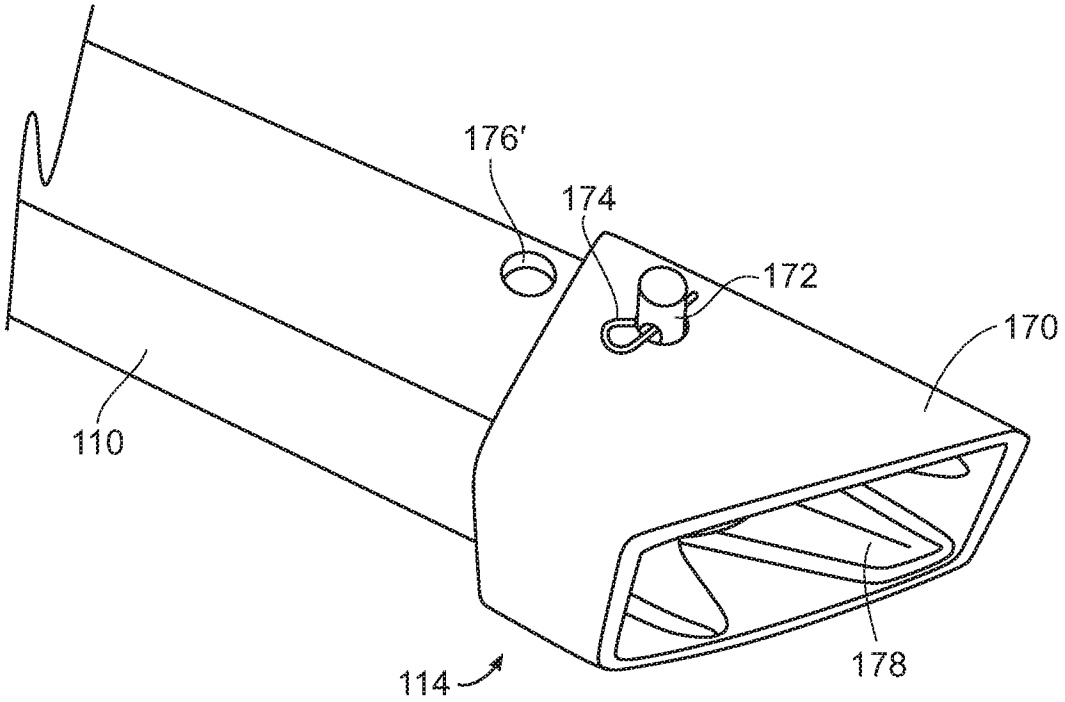
FIG. 33A is another detail perspective view of a spar tip and a tip cover of a portable vehicle barrier in accordance with an example embodiment.
Figure 33B:
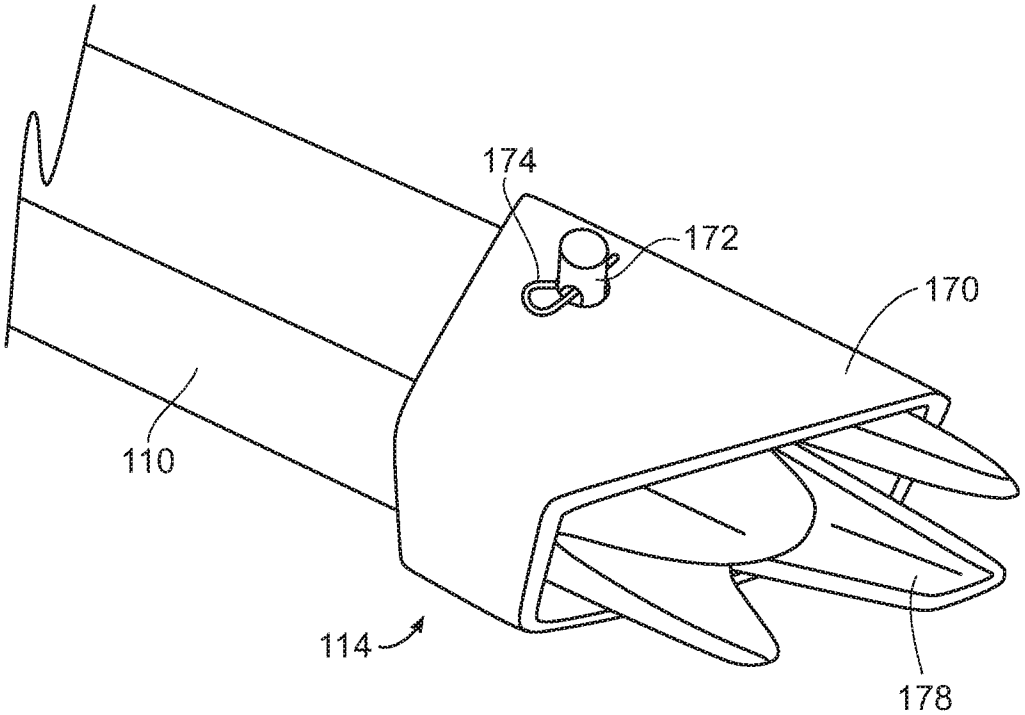
FIG. 33B is another detail perspective view of a spar tip and a tip cover of a portable vehicle barrier in accordance with an example embodiment.
Figure 34:
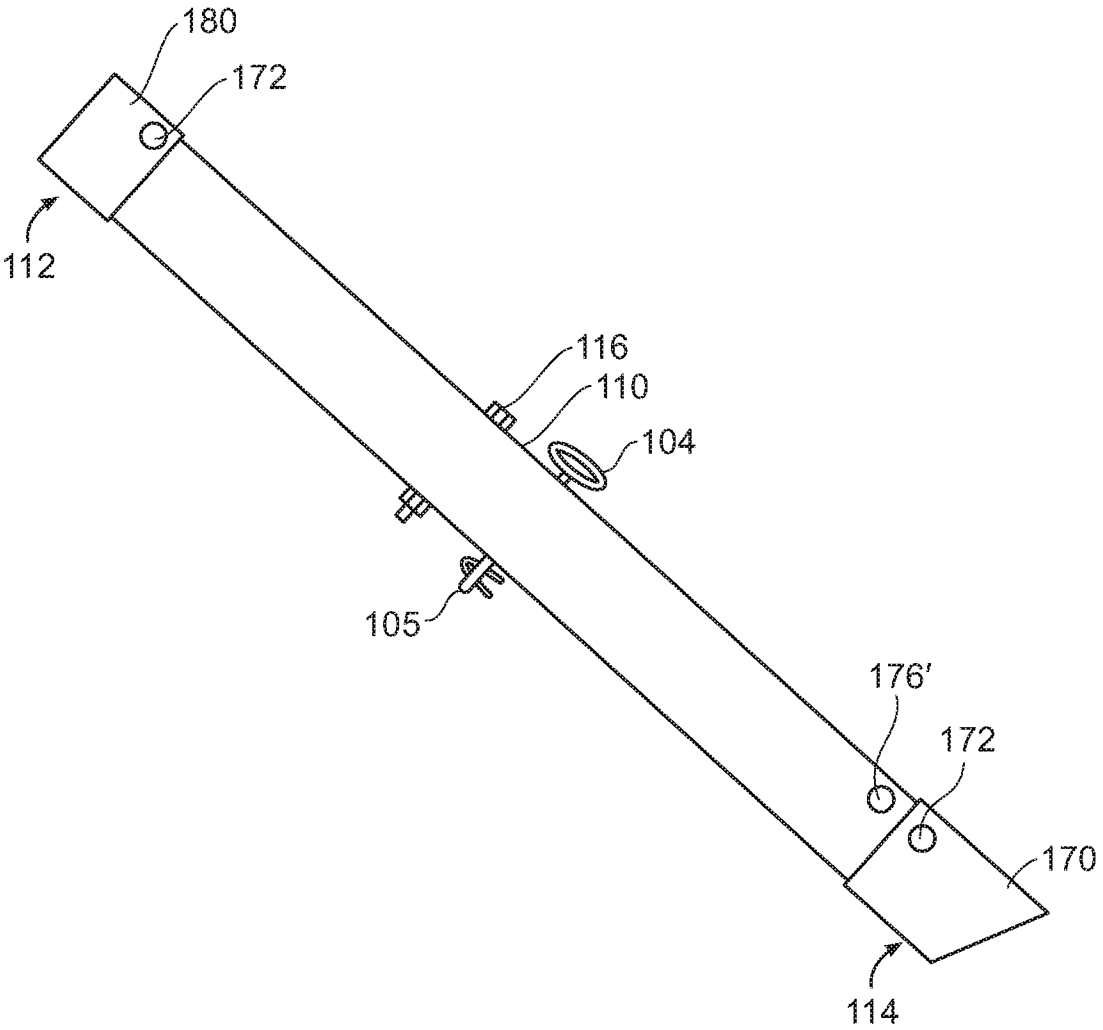
FIG. 34 is a side view of a spar of a portable vehicle barrier in accordance with an example embodiment.

These tips, and others, are typically mounted on one side of a spar 22, such as the upper side when the spar assemblies 20 are folded into a stored position. As best shown in FIG. 14, this mounting configuration allows the spars to be folded as far as possible, until stopped by the spar plates 30, with the spar tips 28 resting on an adjacent spar 22. As mentioned, the spar assemblies 20 can be rotated about a pivot bolt 18 and locked in place with locking pin 17 in either an extended (deployed) state as shown in FIG. 1A, or in a stored state, in which the spar assemblies 20 are generally flat alongside the main beam, as shown in FIG. 14. Various other bolt-on spar tips that can be used with the barrier are shown in FIG. 10, such as an eagle claw tip 28''', a spear-point tip 28'', and the flat tip 28. In addition to vehicle- or ground-engaging tips, the spars 22 may also have small handles 29 attached to them at an end near the main beam 10 or other location, as shown in FIG. 1A. Further, to protect pedestrians or road surfaces, any of the tips may have protective tip covers, such as tip covers 170 and 180, as shown in FIG. 34. If these tip covers are made of plastic or rubber, they will protect people, etc., from sharp tip contacts, but will have little or no effect on performance of any tips, since in use when the barrier is stopping or engaging a vehicle, the relatively soft rubber or plastic tips will deflect, be cut by the spar tips, or fall oft leaving the metal tips or spar ends to engage the ground, road surface, or the underside of a vehicle. As shown in FIGS. 32-34, such a tip cover (for example, cover 170) may be secured over a sharpened, bifurcated or multi-tipped spar end 114 with points 178, or other spar ends, with a locking pin 172 and an R-spring clip 174, although other methods, including a friction fit, are possible as well. As best shown in FIG. 32, a spar end 114 may include two holes, 176 and 176', for receiving locking pin 172. Hole 176' is used if it is desired to retain the cover 170 while still allowing the points 178 to contact the surface, which may be desired, for example, for placement of the barrier on ice. This position is shown in FIG. 33B and FIG. 34, while the tip-protected condition is shown in FIG. 33A.

An alternate type of spar tip, tip 120, is illustrated in FIG. 25. As shown, two such tips may be bolted onto an upper spar end 112 as shown. This type of tip will tend to hook the underside of a vehicle, or underside components, when the vehicle runs into the barrier from either side, while at the same time, the angled bottom ends 114 of the spars will engage with, and dig into, the ground or road surface as a vehicle's weight and forward motion moves the barrier down and away from the vehicle. As mentioned above, a rubber tip cover may also be installed on the lower end 114 of the spars, which can help keep the barrier from slipping instead of engaging the surface. However, because the barrier will tend to rotate underneath a car moving into and over it, either end, and so either tip, of a spar may engage the ground or the bottom of a vehicle.

In addition to rotatable spar assemblies, straight spar assemblies can also be used with the portable vehicle barrier. As shown in FIGS. 25 and 34, especially suitable for a heavy duty vehicle barrier, straight or angled (e.g., in the center) metal tubes may be used to form spars 110 and spar assemblies 111. Such straight spars 110 may extend from either end of the main beam 10, for example, through openings such as opening 101, which is shown without a spar for illustration purposes. As also shown, spars may be inserted into the main beam 10, and for ease of assembly, may be stopped by bolts 116. To create angled, X-shaped spar assemblies, the main beam 10 in this embodiment may be positioned at an angle to the ground, as shown, such as a 45° angle. Because of this angle, spars inserted into the openings 101 will also be at an angle, and the openings 101 can thus be more simply made by cutting or forming them on opposite sides of the main beam 10 as shown. Details of a spar of this type are shown in FIG. 34.

Once the spars are inserted fully, they can be locked in place by handle-type locking pins 104, further secured by locking balls (not shown) or by R-spring clips 105, to retain the pins 104 in place. Of course, other styles of locking pins, or bolts, etc., may also be used to hold the spars in place on the main beam 10. The locking pins 104 extend through holes in the main beam 10 and through the spars. Once so inserted, each spar 110 extends from the opening 101 in the main beam, thus forming half of a spar assembly 111, which comprises four spars next to each other along the main beam 10, in an X-shaped structure. Each such spar assembly may be spaced equidistantly apart along the main beam. Further, each spar 110 may be angularly displaced from each other spar. For example, as shown in FIG. 25, each spar is at a 90° angle from another spar.

Figure 12:
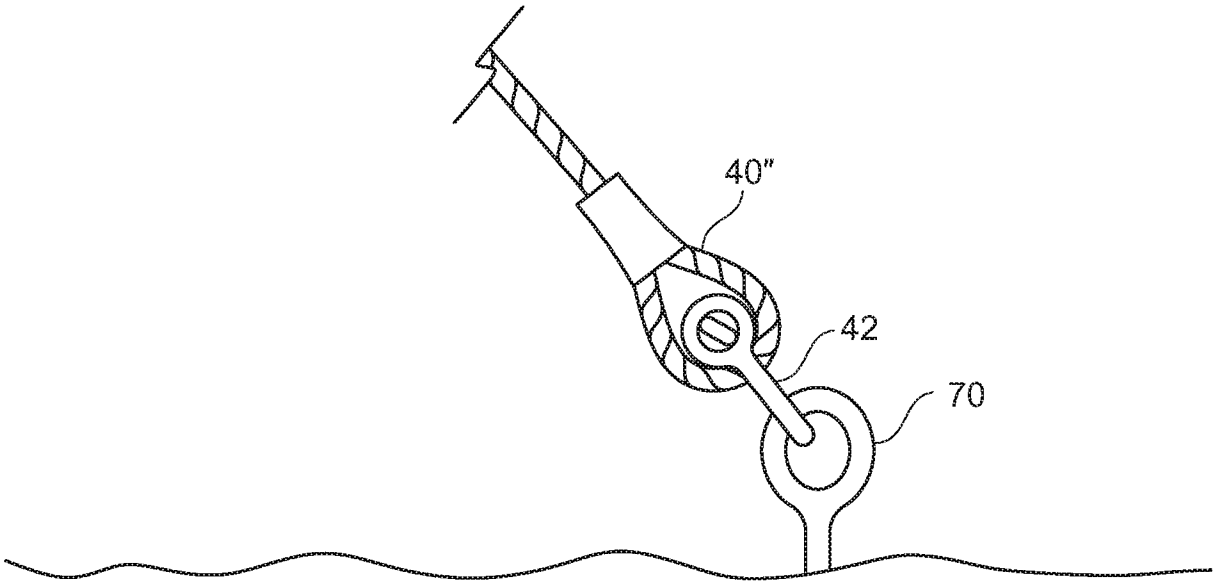
FIG. 12 is a perspective view of a flexible cable attached to a ground auger usable to anchor a vehicle barrier in accordance with an example embodiment.
Figure 28:
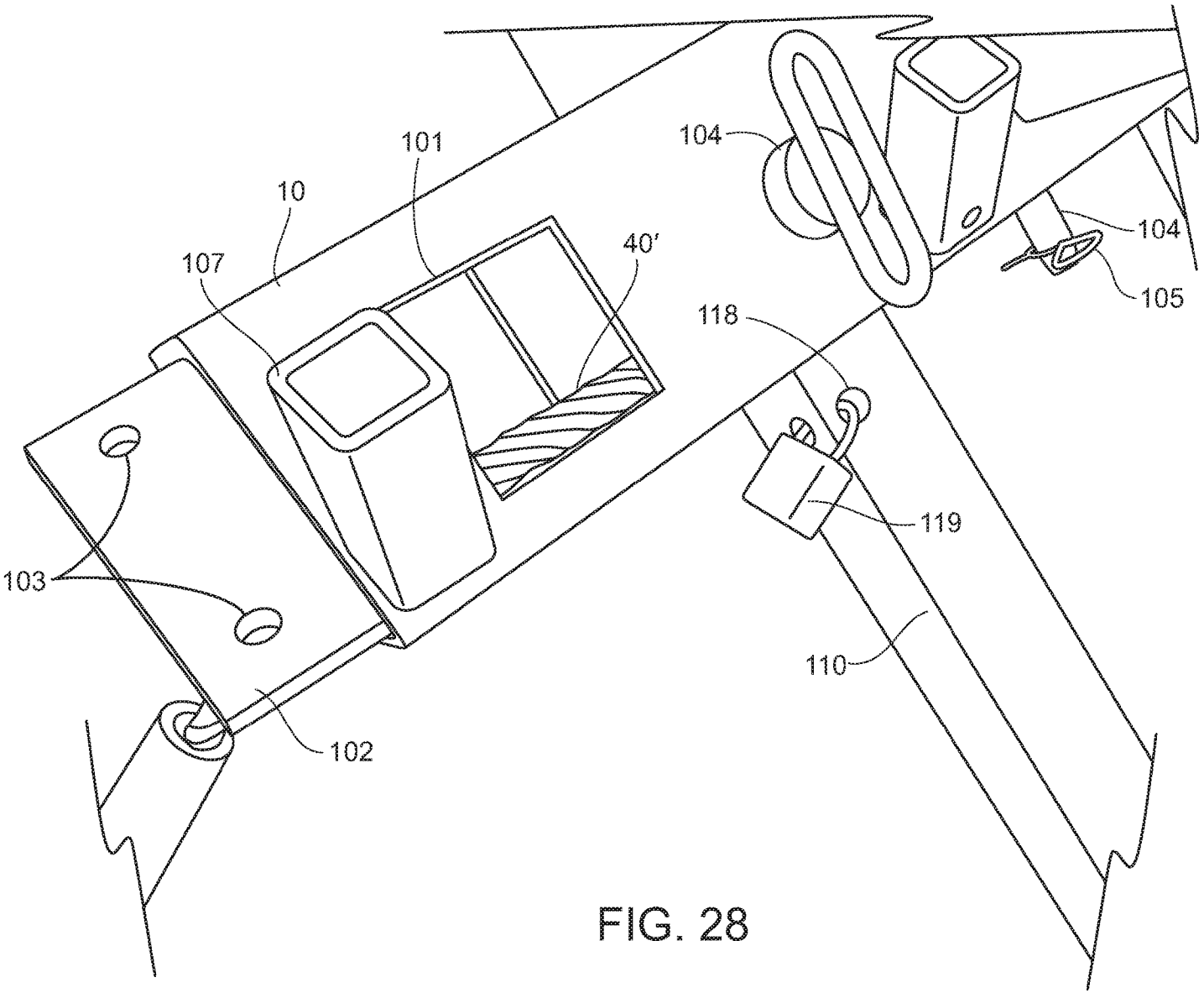
FIG. 28 is a detail perspective view of an alternative example embodiment of a portable vehicle barrier.

FIG. 28 shows in greater detail a spar 110 extending radially outward from the bottom of main beam 10. The Figure also shows an optional lock 119 inserted through lock holes 118 in the spar, which can be used to prevent unauthorized disassembly of the vehicle barrier. FIG. 28 also illustrates in detail mount 102 with mounting holes 103. This mount can be used to attach various tow couplings or accessories (handlebars, etc.) to the main beam 10, or to bolt and couple main beams 10 of this heavy duty style together to create longer, coupled barriers. The barriers can also be coupled by flexible members 40' which can in turn anchor or secure the ends of any number of barriers to a ground anchoring system, such as illustrated in FIG. 12, using an additional flexible member 40" (such as a cable, wire rope, chain, etc.) coupled to a ground anchor 70 by a shackle 42.

Straight or angled spars of the type illustrated in FIG. 34 can also be inserted through openings in main beam 10 of the type shown in FIG. 1A, in addition to the rotatable spar assemblies 20, as needed or desired. Further, shorter spars 110' (FIG. 25, 27) may be used in addition to full-length spars, for example, to accommodate a wheel assembly 140 while still providing additional engagement and stopping power with any vehicles that run into the barrier.

D. Operation of Preferred Embodiments

In use, example embodiments of the portable vehicle barrier are deployed across roads, paths, or any opening where a user or entity desired to prevent access by unauthorized vehicles. One example deployment may be seen in FIGS. 2-6, where a portable vehicle barrier is deployed in the path of an oncoming vehicle to prevent access to an area. As shown in FIG. 1A, the barrier may also have various other features, such as stop sign 56, flashing light 120, banner 122, pedestrian blocking chains 54, etc.

Figure 2:
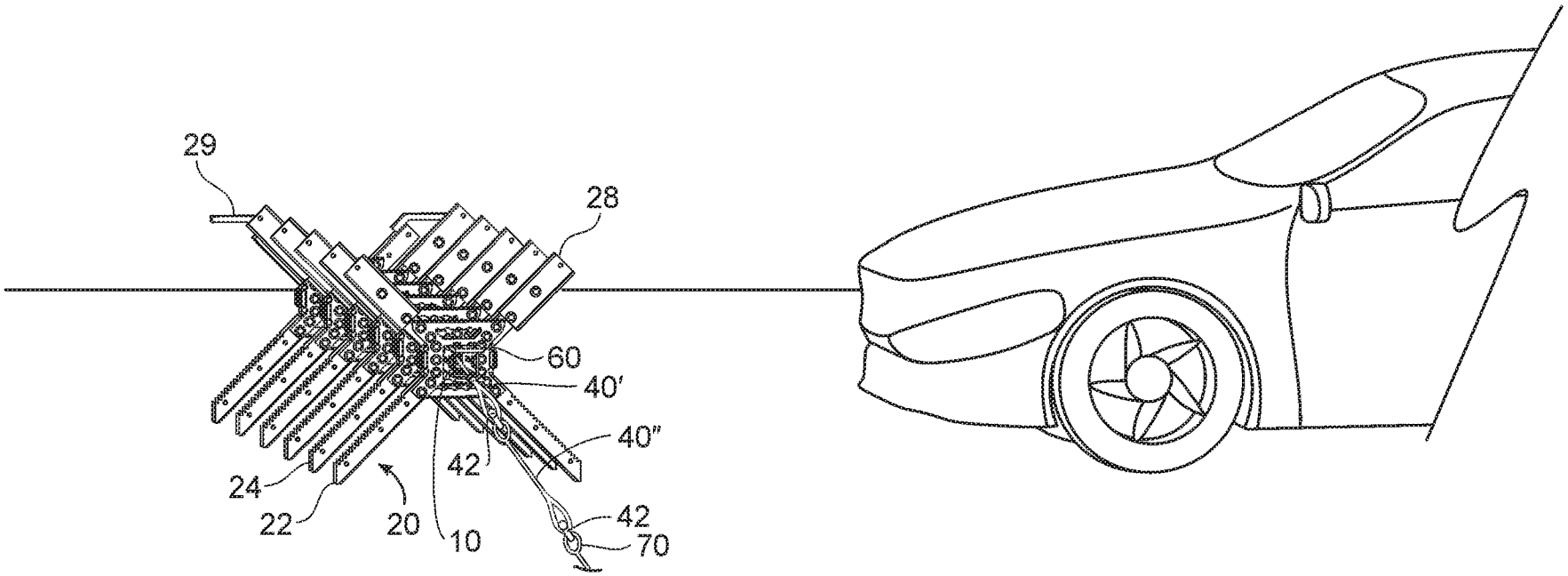
FIG. 2 is another perspective view of a portable vehicle barrier in accordance with an example embodiment.
Figure 3:
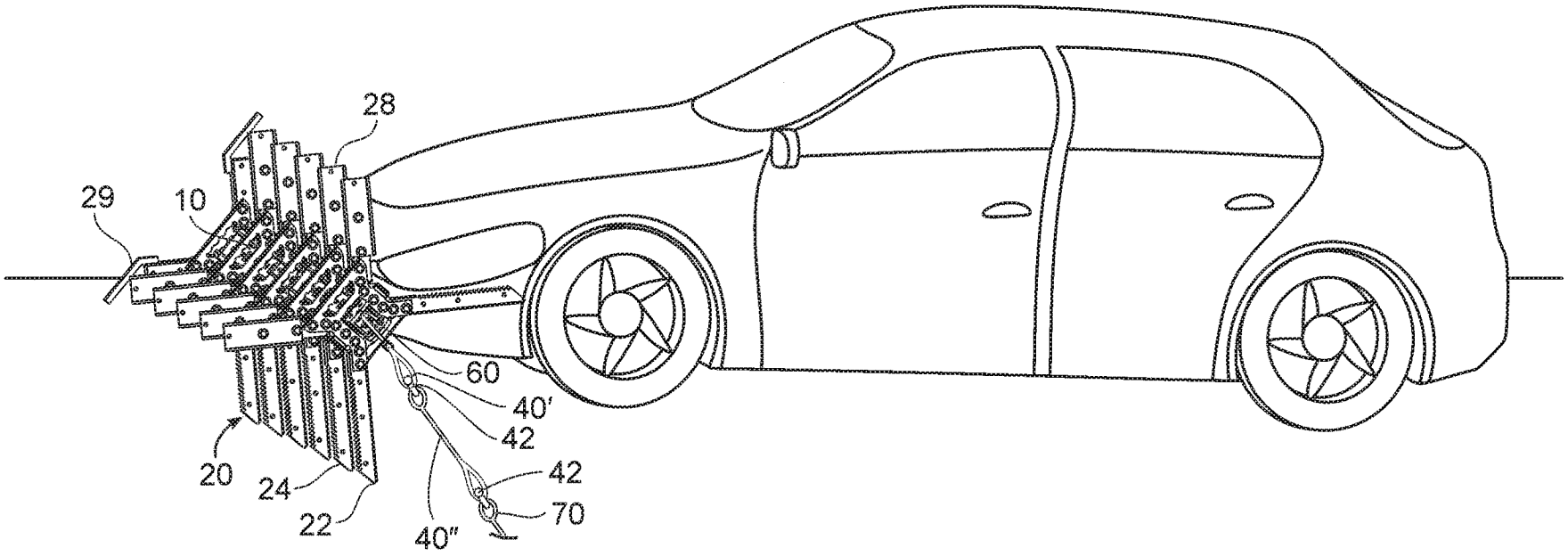
FIG. 3 is another perspective view of a portable vehicle barrier in accordance with an example embodiment.
Figure 4:
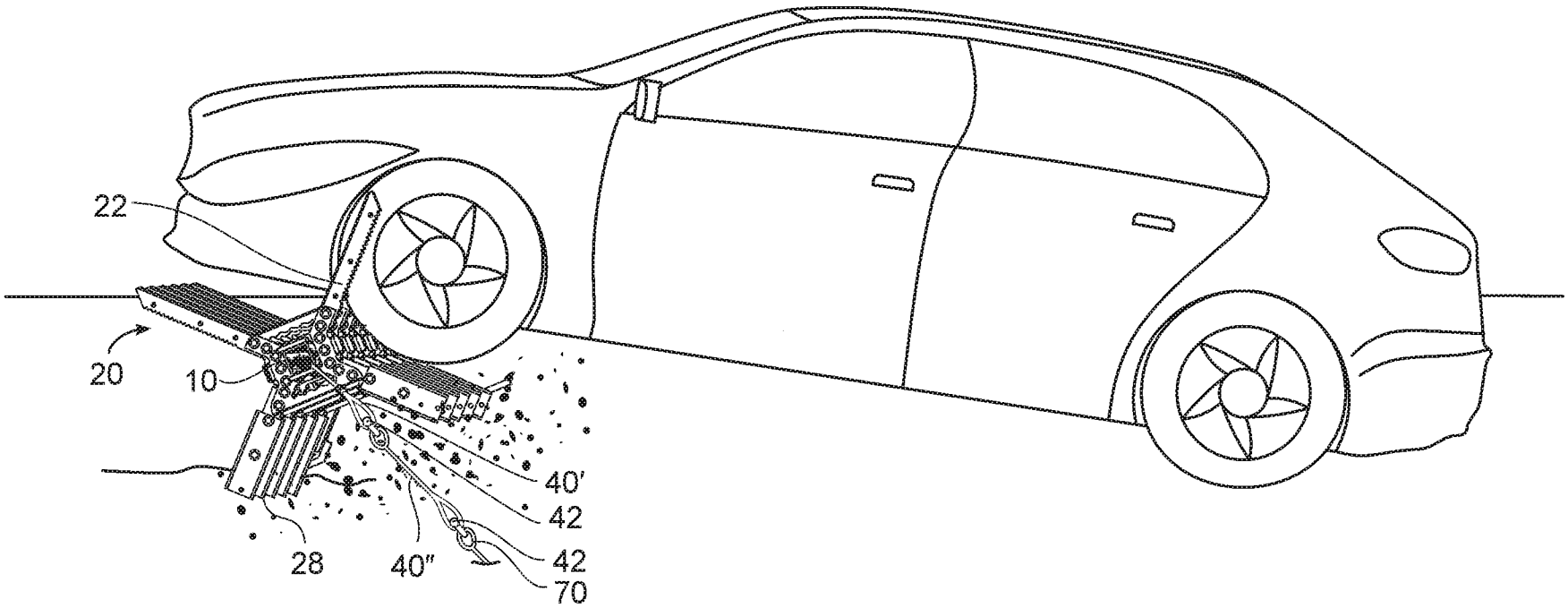
FIG. 4 is another perspective view of a portable vehicle barrier in accordance with an example embodiment.
Figure 5:
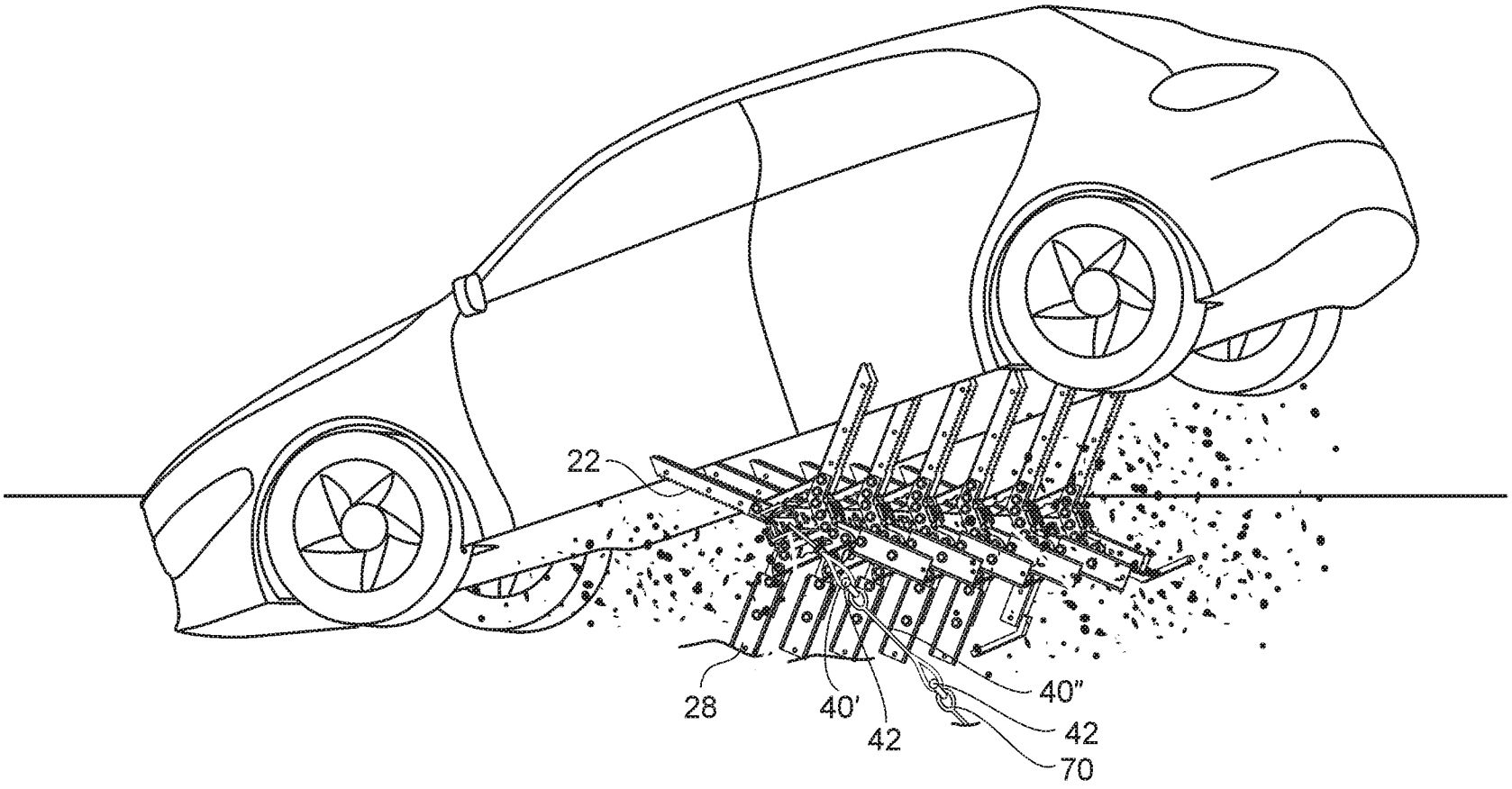
FIG. 5 is another perspective view of a portable vehicle barrier in accordance with an example embodiment.
Figure 6:
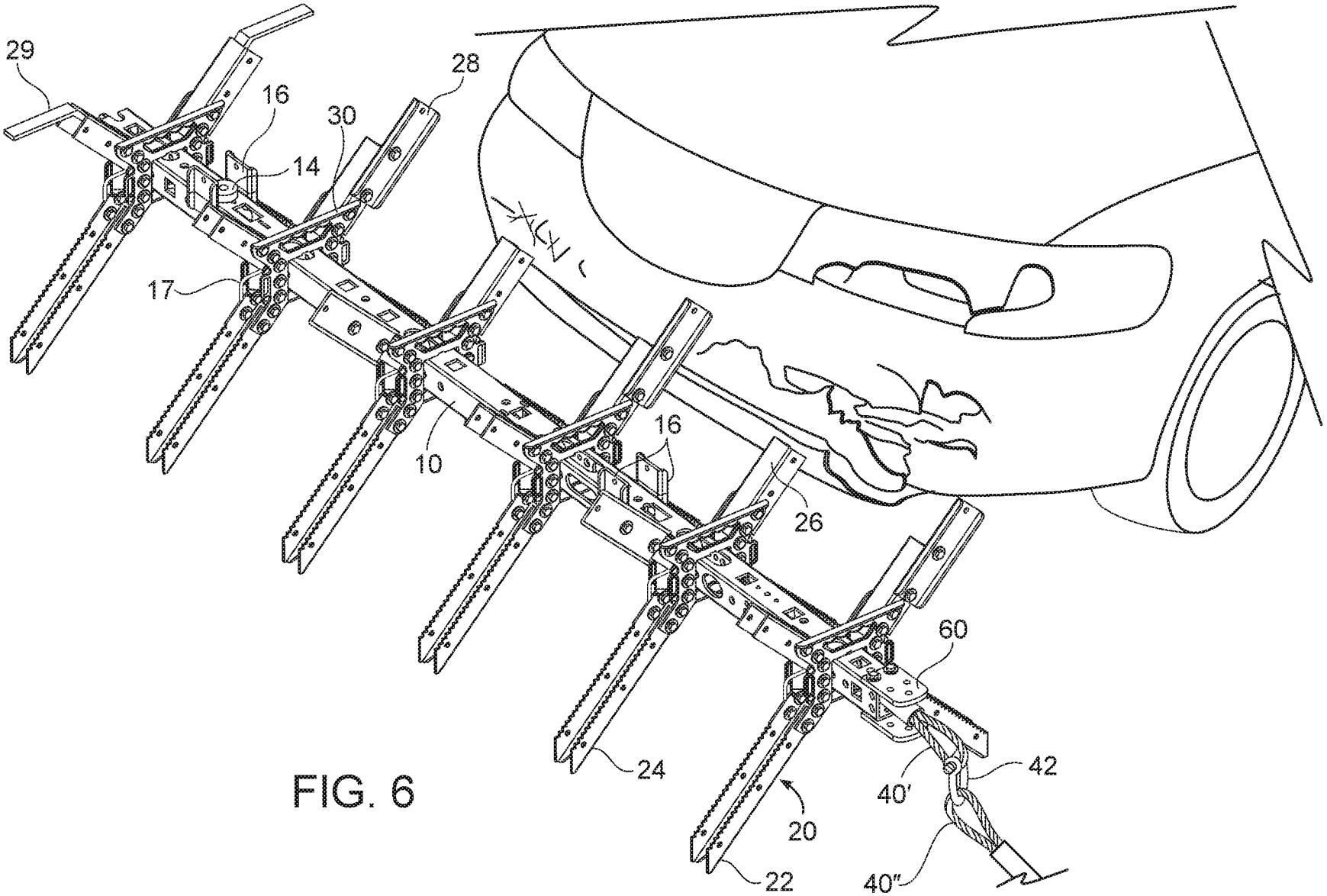
FIG. 6 is another perspective view of a portable vehicle barrier in accordance with an example embodiment.

In addition, the vehicle barrier may include flexible members 40', running inside a hollow main beam 10, or in the case of multiple, coupled barriers, positioned inside multiple hollow main beams, joined together by shackles 42. FIG. 2 shows a vehicle as it approaches the barrier, and FIGS. 3 and 6 as it makes contact with the vehicle barrier. As shown, the lower spars 22 are angled toward the ground, while upper spars 22, with spar tips 28, are angled toward, and engaging, the vehicle. As the vehicle continues forward, the upper spars will typically penetrate parts of the vehicle, both the front and the underside, and the tires, and the barrier will rotate and tend to lift the vehicle (as shown in FIG. 4) as the vehicle causes the spars to penetrate and become somewhat embedded in the ground on one side, and the upper spars to further penetrate or at least engage the underside of the vehicle.

As the vehicle continues to move forward, the barrier will typically continue to rotate underneath it, with the spars that were initially in contact with the ground to rotate into contact with the underside of the vehicle, continuing to slow the vehicle and penetrate the underside of it. The vehicle barrier, as noted previously, may include an anchoring system comprising flexible members 40', coupled to anchoring flexible members 40", which in turn may be coupled to ground anchors 70. Shackles 42 may connect the various flexible members. The rotation of the barrier may continue until the vehicle is stopped. In an anchored embodiment, the main beam 10 may deform in this process, although it will continue to function.

Figure 9:
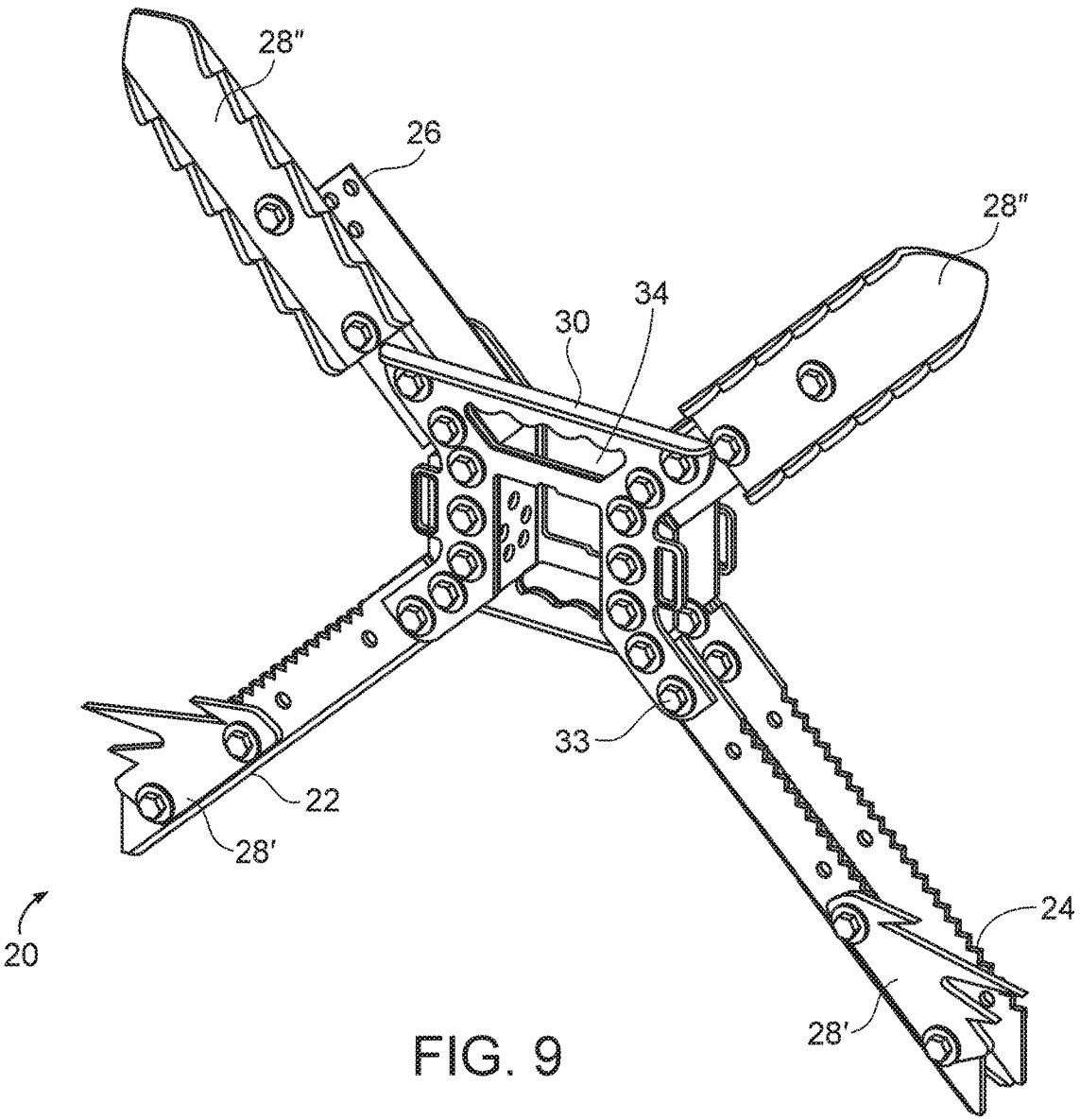
FIG. 9 is another perspective view of a spar assembly of a vehicle barrier in accordance with an example embodiment.

Due to their X-shape, the spar assemblies 20, 111, will result in a plurality of spars 22, 110, always being positioned between the ground and a vehicle after the vehicle has encountered the barrier, even as the barrier rotates under the vehicle. Accordingly, the vehicle will continue to slow as it moves over the barrier, and to sustain damage. As shown in FIG. 9, it is possible for the barrier to hold the vehicle, and especially it rear wheels, off the ground, which will further prevent motion, and the ability of a driver to drive the vehicle further. Also due to their X-shape, which can, in some examples, be generally symmetrical about a vertical plane through the main beam, the spar assemblies are equally effective at stopping vehicles from either direction, making the barrier bidirectional. Further, the spars 20, 110, may be equipped with a great variety of either permanently formed or bolt-on tips designed to engage the ground or the underside of a vehicle.

Where the tips are sharp and could otherwise present a hazard to pedestrians, etc., they may have relatively soft, protective tip covers (E.G., rubber, plastic, etc.), as shown in FIGS. 32-34, which illustrates a plastic protective cover 170 in place over a multi-point spar end 114 and a rubber cover 180 over the opposite end 112. The cover 170 protects the multiple tips 178 ordinarily, but when a vehicle is engaged by the spar, the cover will not affect the tip, which will, in this case, typically spread out and/or puncture the underside of the vehicle.

Figure 7:
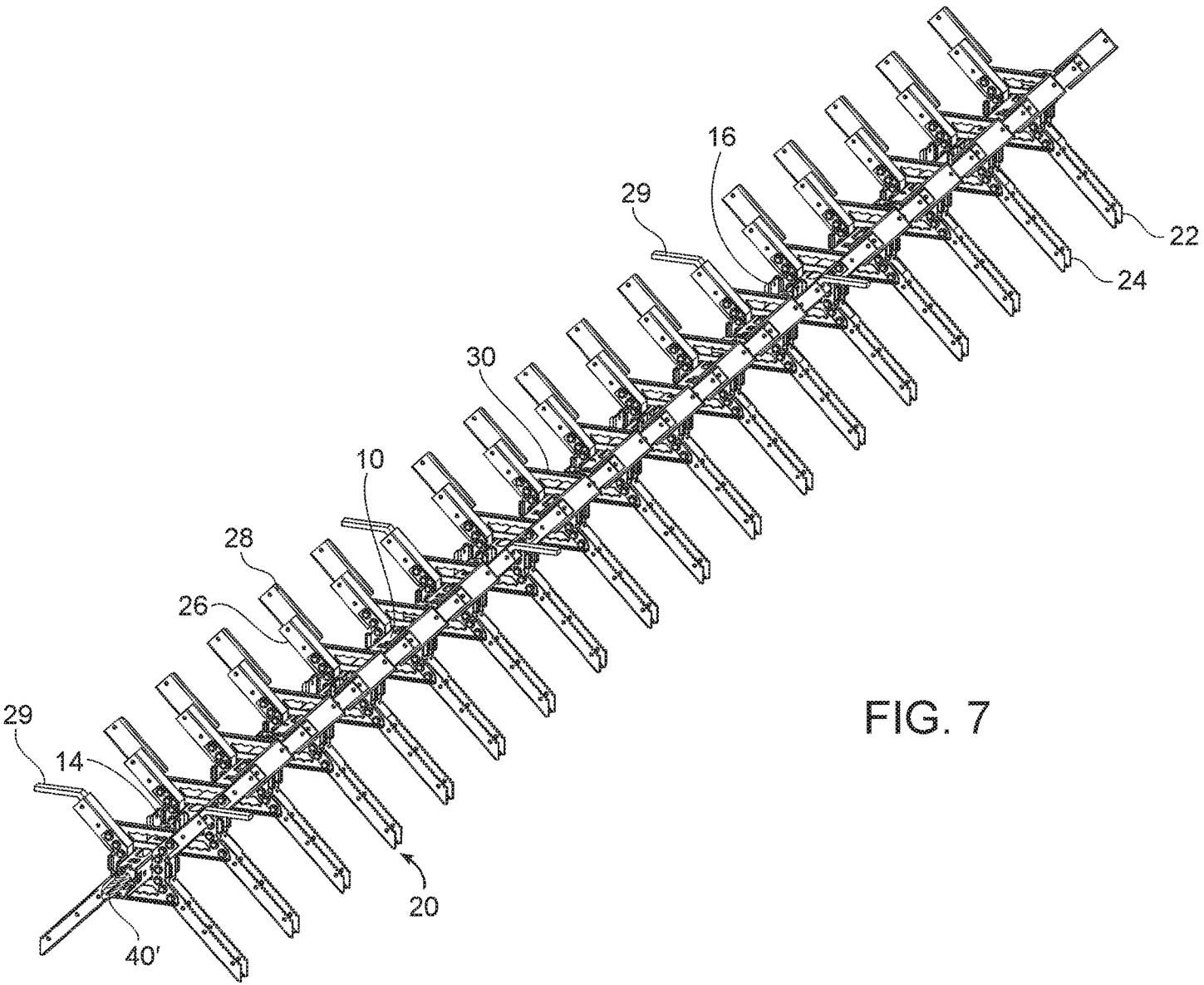
FIG. 7 is perspective view of two portable vehicle barriers coupled together in accordance with an example embodiment.

As mentioned briefly above, two or more vehicle barriers can be coupled together to prevent vehicles from entering an area. As an example, FIG. 7 shows three standard duty units coupled together. In addition to being joined at their ends, the flexible members 40' can be coupled together between each main beam 10, so that the entire barrier assembly can be anchored to the ground by a ground anchor 70 or other structure, as shown in FIG. 12. Due to their hollow beams, any embodiment of vehicle barrier disclosed herein can have its main beams 10 coupled together, as well as joined together by cables or other flexible members. Further, such coupled barriers can be "staged" prior to deployment and then rapidly towed to a desired location in fully extended form. In addition, in areas where repeated need for a barrier is likely, a set or sets of ground anchors 70 can be installed in-ground and inconspicuously left in place or hidden until a barrier is needed, at which time the barriers may be quickly attached to the ground anchors by flexible members 40' and 40", as shown in FIG. 2.

Figure 16:
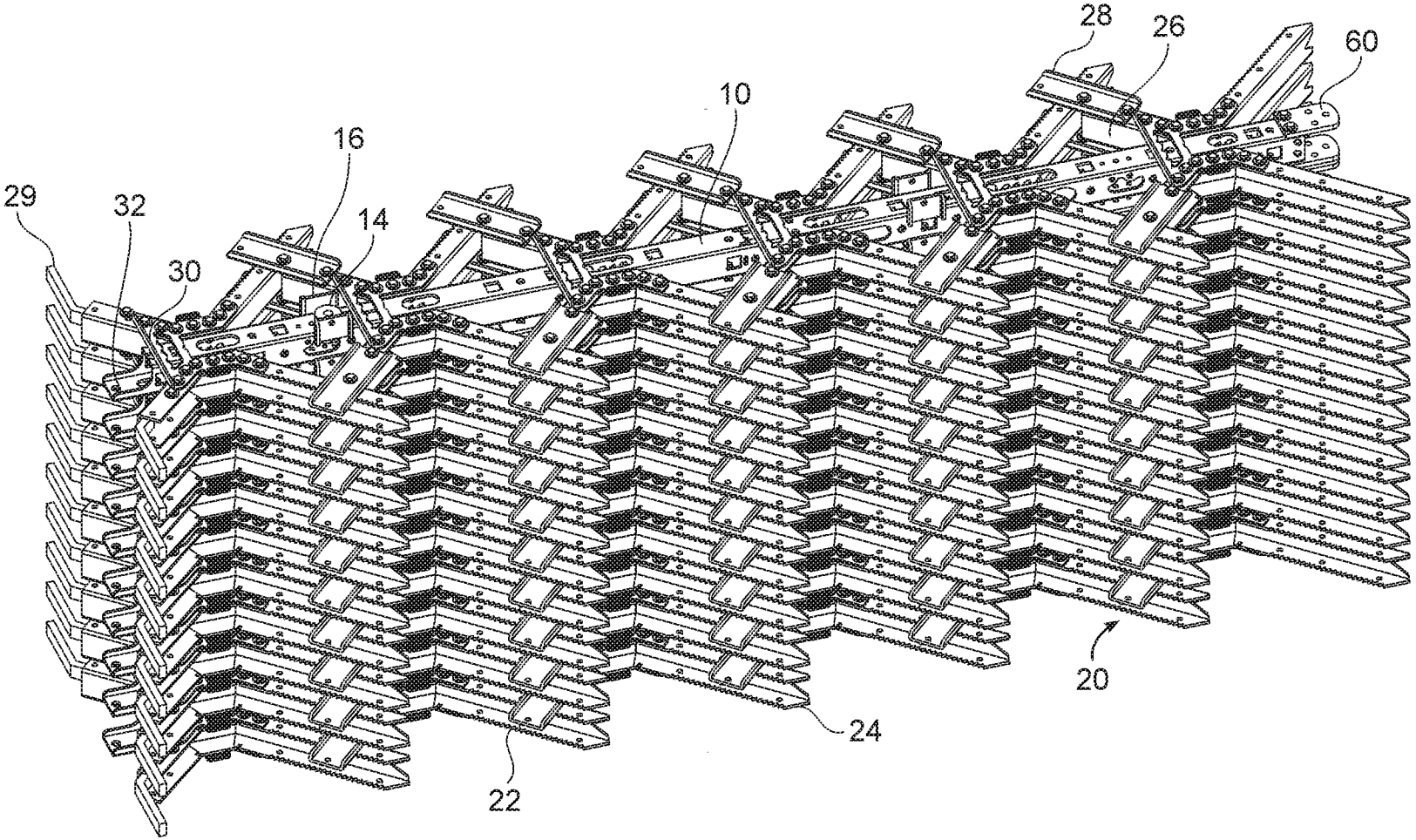
FIG. 16 is a perspective view of multiple, stacked vehicle barriers in a stored state in accordance with an example embodiment.
Figure 21:
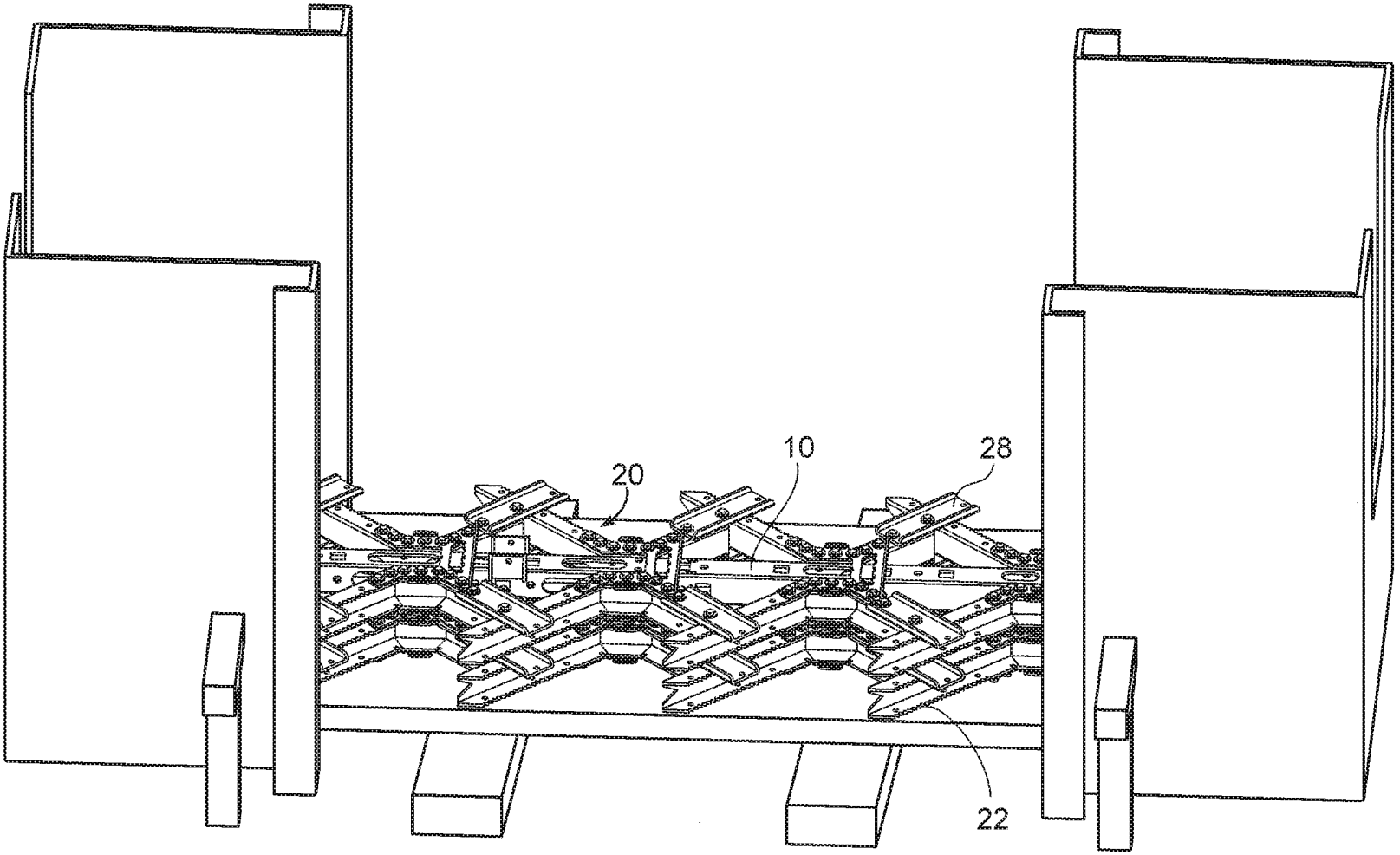
FIG. 21 is a perspective view of a two vehicle barriers in a stored state in a transport rack in accordance with an example embodiment.
Figure 22:
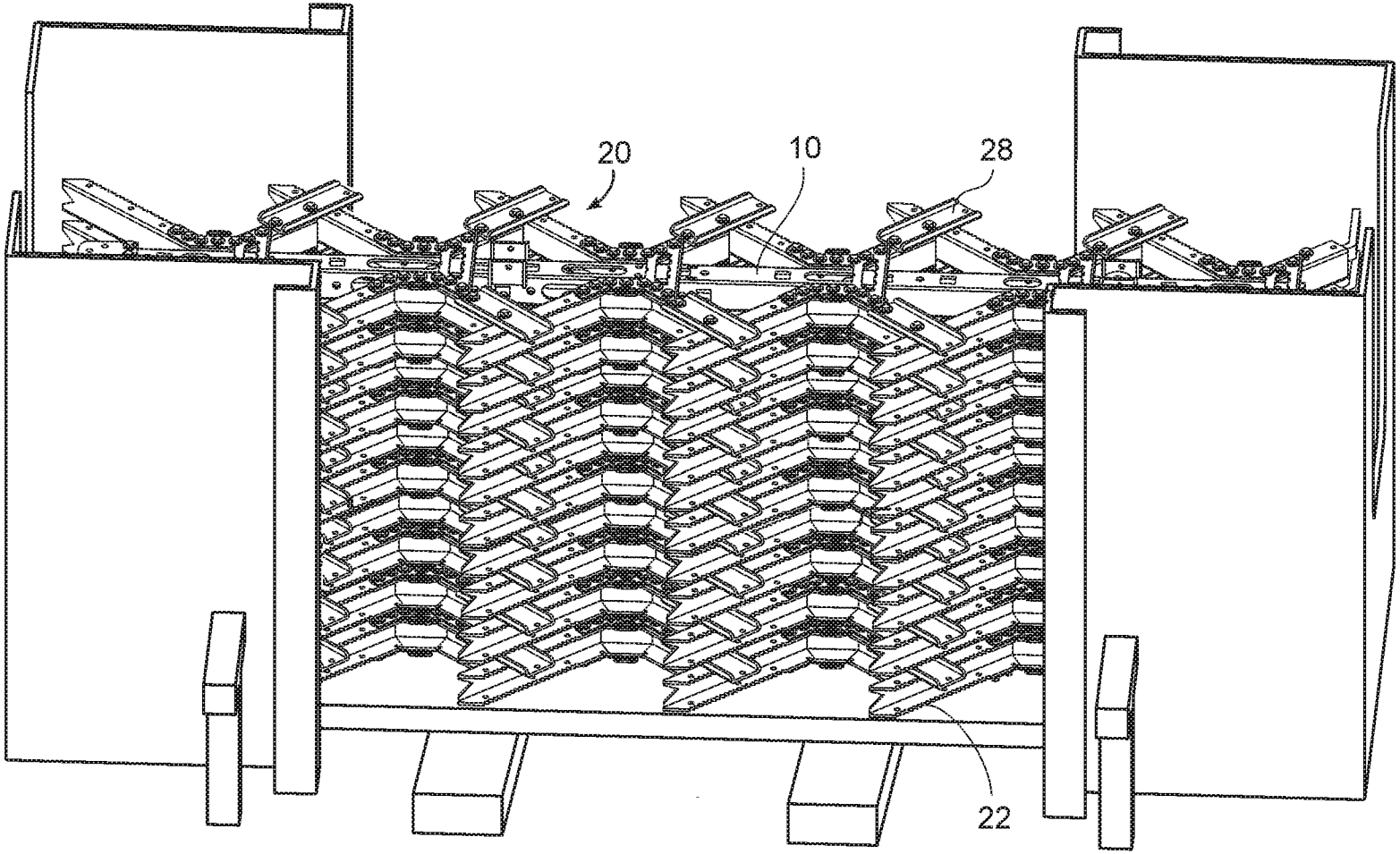
FIG. 22 is a perspective view of ten vehicle barriers in a stored state in a transport rack in accordance with an example embodiment.

When not in use, or for transport, in some embodiments, the vehicle barrier's spar assemblies 20 can be folded flat, as shown for example, in FIGS. 14-16, so that each barrier is nearly as flat as the main beam 10. This allows for efficient storage and transport of a large number of units if needed. To prevent damage to the finish or any protective coatings, etc., the main beam 10 may include a number of bumpers 14 to hold stacked beams apart. The main beams may also include guide tabs 16 to keep the units stacked on top of each other, as best illustrated in FIG. 16. FIGS. 21 and 22 illustrate the compactness of vehicle barriers in the stored state. In FIG. 22, ten vehicle barriers with their spar assemblies in a storage state are shown stacked in a special purpose rack that may be used to transport the barriers. The rack may be adapted for transport with a forklift or a set of wheels, etc., and is typically less than about 6 feet high.

Unless otherwise defined, all technical and scientific terms used herein have the same meaning as commonly understood by one of ordinary skill in the art to which this invention belongs. Although methods and materials similar to or equivalent to those described herein can be used in the practice or testing of the portable vehicle barrier, suitable methods and materials are described above. All publications, patent applications, patents, and other references mentioned herein are incorporated by reference in their entirety to the extent allowed by applicable law and regulations. The portable vehicle barrier may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A portable vehicle barrier to prevent passage of a vehicle, comprising:

a main beam; and a plurality of spar assemblies attached to the main beam, the plurality of spar assemblies being spaced apart along the main beam;

wherein each of the plurality of spar assemblies comprises a plurality of spars that are angularly spaced apart from one another and extend outwardly from the main beam;

wherein the main beam has a plurality of openings spaced apart along the main beam, and wherein each of the plurality of spar assemblies comprises a first spar and a second spar that extend through corresponding openings.

2. The portable vehicle barrier of claim 1, wherein the plurality of spars radially extend outwardly from the main beam.

3. The portable vehicle barrier of claim 1, wherein the main beam is hollow and comprises a first end and a second end, further comprising a flexible member inside the main beam, the flexible member being removably attachable to flexible anchor members beyond the first end and the second end to anchor the portable vehicle barrier.

4. The portable vehicle barrier of claim 1, wherein the plurality of spars in each of the plurality of spar assemblies are angularly spaced apart by 90°.

5. The portable vehicle barrier of claim 1, wherein each of the plurality of spar assemblies forms an X-shaped structure, and wherein at least one of the spars comprises a protective tip cover.

6. The portable vehicle barrier of claim 1, wherein each of the plurality of spar assemblies forms an X-shaped structure.

7. The portable vehicle barrier of claim 1, wherein the plurality of spar assemblies are spaced apart equidistantly along the main beam.

8. The portable vehicle barrier of claim 1, wherein the first spar and the second spar of each spar assembly are angularly spaced apart from one another.

9. The portable vehicle barrier of claim 1, wherein the plurality of spars extend radially through the main beam.

10. The portable vehicle barrier of claim 9, wherein the main beam is hollow and comprises a first end and a second end, further comprising a flexible member inside the main beam, the flexible member being removably attachable to flexible anchor members beyond the first end and the second end to anchor the portable vehicle barrier.

11. The portable vehicle barrier of claim 9, wherein the plurality of spar assemblies are spaced apart equidistantly along the main beam.

12. The portable vehicle barrier of claim 1, wherein the plurality of spars are releasably attached to the main beam by a plurality of locking pins that each extend through a spar and the main beam.

13. The portable vehicle barrier of claim 1, wherein at least one of the plurality of spars comprises a protective tip cover.

14. The portable vehicle barrier of claim 1, wherein at least one of the plurality of spars comprises a bifurcated tip.

15. The portable vehicle barrier of claim 1, wherein the spars of at least one spar assembly define a plane that is not perpendicular to the main beam.

16. The portable vehicle barrier of claim 1, further comprising a first plurality of wheels coupled to and supporting the main beam, wherein at least one of the wheels is rotatable by 360° about a vertical axis.

17. The portable vehicle barrier of claim 16, further comprising a wheel assembly coupled to the main beam by a jack, wherein the wheel assembly can be retracted with the jack to a position proximate the main beam so that a second plurality of wheels of the wheel assembly can be removed from the wheel assembly.

18. The portable vehicle barrier of claim 1, wherein at least one of the spars comprises a tip cover having an extended state and a retracted state, wherein in the extended state the tip cover extends past an end of the spar, and wherein in the retracted state, the tip cover is spaced away from the end of the spar.

* * * * *